US010946641B2

(12) United States Patent
Hasegawa et al.

(10) Patent No.: US 10,946,641 B2
(45) Date of Patent: Mar. 16, 2021

(54) CONTROL DEVICE CONTROLLING PRINTER PROVIDED WITH HEAD AND CAPABLE OF PRINTING IN A PLURALITY OF MODES

(71) Applicant: BROTHER KOGYO KABUSHIKI KAISHA, Aichi (JP)

(72) Inventors: Shin Hasegawa, Nagoya (JP); Masashi Kuno, Obu (JP); Shota Morikawa, Nagoya (JP); Satoru Arakane, Nagoya (JP); Yoshiharu Furuhata, Nagoya (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 16/728,073

(22) Filed: Dec. 27, 2019

(65) Prior Publication Data

US 2020/0207075 A1 Jul. 2, 2020

(30) Foreign Application Priority Data

Dec. 28, 2018 (JP) ..... JP2018-248617

(51) Int. Cl.
*B41J 2/045* (2006.01)

(52) U.S. Cl.
CPC ..... *B41J 2/04508* (2013.01); *B41J 2/04581* (2013.01)

(58) Field of Classification Search
CPC ..... B41J 2/04508; B41J 2/04581; B41J 2/17509; B41J 29/02; B41J 29/38; B41J 29/13; B41J 2/04551
USPC ..... 347/14
See application file for complete search history.

(56) References Cited

U.S. PATENT DOCUMENTS

2007/0070112 A1* 3/2007 Ootsuka ..... B41J 2/19 347/20
2008/0297546 A1* 12/2008 Lee ..... B41J 2/18 347/6
2012/0200619 A1* 8/2012 Bibl ..... B41J 2/175 347/6
2018/0215168 A1* 8/2018 Nabeshima ..... B41J 2/14201
2019/0001689 A1* 1/2019 Ishida ..... B41J 2/17596

FOREIGN PATENT DOCUMENTS

JP 2010-214726 A 9/2010

* cited by examiner

*Primary Examiner* — Huan H Tran
*Assistant Examiner* — Alexander D Shenderov
(74) *Attorney, Agent, or Firm* — Scully, Scott, Murphy & Presser, PC

(57) ABSTRACT

In a control device, a controller is configured to perform: executing a first print printing a first partial image in a first printing area and a second print printing a second partial image in a second printing area; setting a first ink pressure value for the first print; obtaining a recovery value to be recovered in a time period from completion of the first print to start of the second print; calculating a residual pressure value based on the first ink pressure value and the recovery value; setting a second ink pressure value for the second print using the residual pressure value; and determining whether the second ink pressure value reaches a threshold value. A first mode of print is performed when the second ink pressure value does not reach the threshold value. A second mode of print is performed when the second ink pressure value reaches the threshold value.

15 Claims, 13 Drawing Sheets

CONTROL DEVICE CONTROLLING PRINTER PROVIDED WITH HEAD AND CAPABLE OF PRINTING IN A PLURALITY OF MODES

CROSS REFERENCE TO RELATED APPLICATION

This application claims priority from Japanese Patent Application No. 2018-248617 filed Dec. 28, 2018. The entire content of the priority application is incorporated herein by reference.

TECHNICAL FIELD

The present disclosure relates to a control device for controlling a printer provided with a head into which ink stored in receptacles is supplied via channels, and a set of program instructions executed on the control device.

BACKGROUND

An inkjet printer known in the art is provided with: ink cartridges; ink supply tubes connected to the ink cartridges; a carriage unit connected to the ink supply tubes; and a control device. The carriage unit is provided with: buffer tanks connected to the ink supply tubes; an ejecting head having inflow ports into which ink flows from the buffer tanks; and pressure sensors that detect the pressure of ink in the inflow ports. The ejecting head has: channels in communication with the inflow ports; nozzles in communication with the channels; and piezoelectric-driven actuators that eject ink from the nozzles.

The control device described above determines the flow resistance of ink in the channels of the ejecting head on the basis of the pressure detected by the pressure sensors, and controls printing without limiting the printing duty cycle when the determined flow resistance is smaller than a threshold value. However, when the flow resistance is greater than the threshold value, the control device limits the printing duty cycle to prevent a situation in which the quantity of ink being supplied to the ejecting head is insufficient.

SUMMARY

The inkjet printer described above requires pressure sensors to determine whether the quantity of ink supplied to the ejecting head will be insufficient.

In view of the foregoing, it is an object of the present disclosure to provide a control device and a set of program instructions therefor capable of determining, without the use of pressure sensors, whether the quantity of ink supplied to the ejecting head will be insufficient in order to be able to change the mode of printing.

In order to attain the above and other objects, the present disclosure provides a control device configured to control a printer. The printer includes: a head; and a moving device. The head is connectable via a channel to a receptacle accommodating therein ink. The head has: a plurality of nozzles; and a plurality of drive elements. The plurality of nozzles is configured to eject ink. The plurality of drive elements is provided corresponding to respective ones of the plurality of nozzles. The moving device is configured to move the head relative to a printing medium. The control device includes: a memory; and a controller. The memory is configured to store a threshold value for an ink pressure that ink exerts on the head. The controller is configured to perform: (a) acquiring; (b) executing; (c) setting; (d) obtaining; (e) calculating; (f) setting; and (g) determining The (a) acquiring acquires print data representing an image. The (b) executing executes each of a plurality of prints for printing the image on the printing medium by selectively driving the plurality of drive elements. The image is made up of a plurality of partial images arranged in a first direction. The plurality of prints prints respective ones of the plurality of partial images in respective ones of a plurality of printing areas on the printing medium. The plurality of printing areas is arranged in the first direction on the printing medium. The plurality of prints includes a first print and a second print subsequent to the first print. The first print prints a first partial image in a first printing area. The second print prints a second partial image in a second printing area successively positioned with respect to the first printing area in the first direction. The (c) setting sets a first ink pressure value using the print data. The first ink pressure value corresponds to the ink pressure for the first print. The (d) obtaining obtains a recovery value specifying a value of the ink pressure to be recovered in a time period from completion of the first print to start of the second print. The (e) calculating calculates a residual pressure value based on the first ink pressure value and the recovery value. The (f) setting sets a second ink pressure value using the print data and the residual pressure value. The second ink pressure value corresponds to the ink pressure for the second print. The (g) determining determines whether the second ink pressure value reaches the threshold value. The (b) executing executes one of a first mode of print and a second mode of print different from the first mode of print. The first mode of print is performed in response to determining that the second ink pressure value does not reach the threshold value. The second mode of print is performed in response to determining that the second ink pressure value reaches the threshold value.

According to another aspect, the present disclosure provides a non-transitory computer readable storage medium storing a set of program instructions for a control device. The control device is configured to control a printer. The printer includes: a head; and a moving device. The head is connectable via a channel to a receptacle accommodating therein ink. The head has: a plurality of nozzles; and a plurality of drive elements. The plurality of nozzles is configured to eject ink. The plurality of drive elements is provided corresponding to respective ones of the plurality of nozzles. The moving device is configured to move the head relative to a printing medium. The control device includes: a memory; and a controller. The memory is configured to store a threshold value for an ink pressure that ink exerts on the head. The set of program instructions, when installed on and executed by the controller, causes the control device to perform: (a) acquiring; (b) executing; (c) setting; (d) obtaining; (e) calculating; (f) setting; and (g) determining The (a) acquiring acquires print data representing an image. The (b) executing executes each of a plurality of prints for printing the image on the printing medium by selectively driving the plurality of drive elements. The image is made up of a plurality of partial images arranged in a first direction. The plurality of prints prints respective ones of the plurality of partial images in respective ones of a plurality of printing areas on the printing medium. The plurality of printing areas is arranged in the first direction on the printing medium. The plurality of prints includes a first print and a second print subsequent to the first print. The first print prints a first partial image in a first printing area. The second print prints a second partial image in a second printing area successively positioned with respect to the first printing area in the first direction. The (c) setting sets a first ink pressure value using the print data. The first ink pressure value corresponds to the ink pressure for the first print. The (d) obtaining obtains a recovery value specifying a value of the ink pressure to be recovered in a time period from completion of the first print to start of the second print. The (e) calculating calculates a residual pressure value based on the first ink pressure value and the recovery value. The (f) setting sets a second ink pressure value using the print data and the residual pressure value. The second ink pressure value corresponds to the ink pressure for the second print. The (g) determining determines whether the second ink pressure value reaches the threshold value. The (b) executing executes one of a first mode of print and a second mode of print different from the first mode of print. The first mode of print is performed in response to determining that the second ink pressure value does not reach the threshold value. The second mode of print is performed in response to determining that the second ink pressure value reaches the threshold value.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Hereinafter, an embodiment of the present disclosure will be described with reference to the accompanying drawings. The embodiment described below is merely an example of the present disclosure, and it would be apparent to those skilled in the art that the embodiment of the present disclosure may be modified as appropriate without departing from the spirit of the disclosure. For example, the order for executing steps in the processes described below may be modified as needed without departing from the spirit of the disclosure.

Figure 1A:
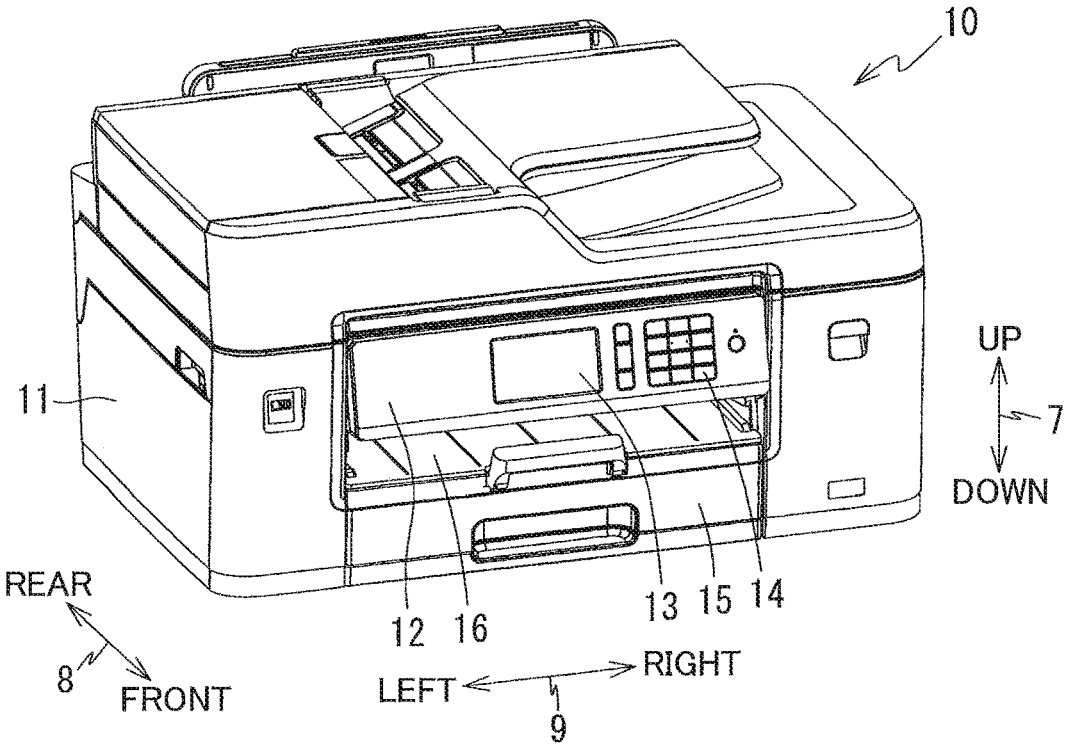
FIG. 1A is a perspective view of a printer according to one embodiment in which a cover is at a closed position.
Figure 1B:
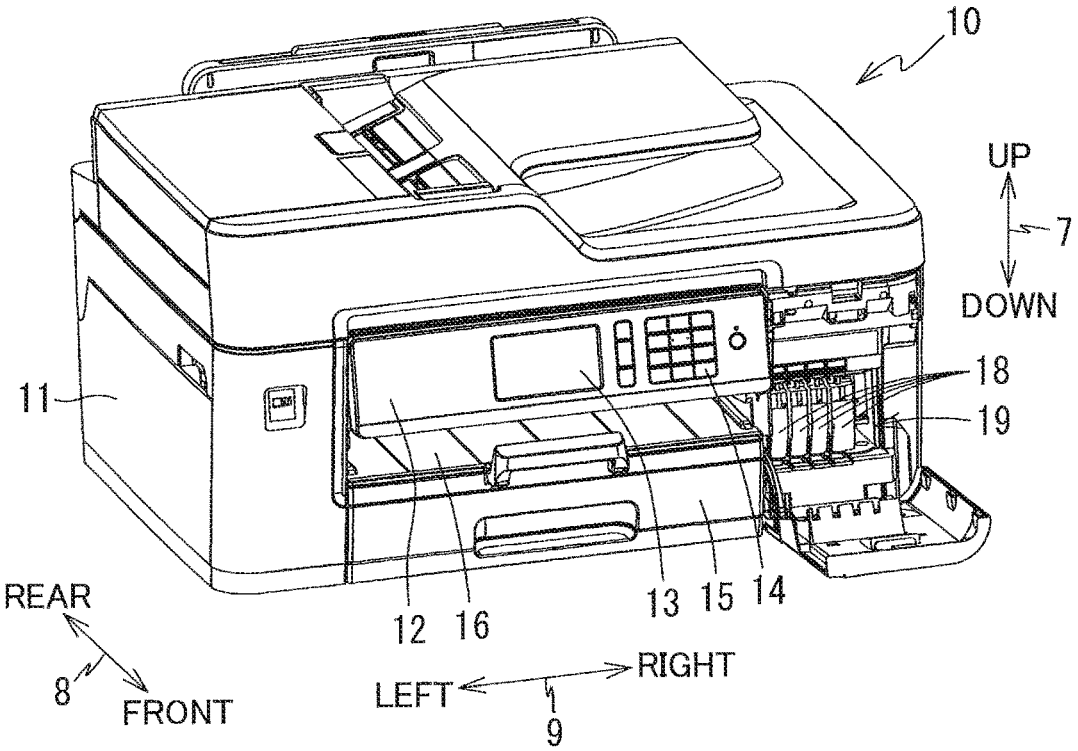
FIG. 1B is a perspective view of the printer according to the embodiment in which the cover is at an open position.

FIGS. 1A and 1B illustrate a printer 10. The printer 10 prints images on sheets 6 (see FIG. 2) as an example of the printing medium by ejecting ink onto the sheets 6. That is, the printer 10 is referred to as an inkjet printer.

While printing images on sheets 6, the printer 10 also moves a head 62 (see FIG. 2) that ejects ink. Hence, the printer 10 is also known as a serial printer.

Figure 2:
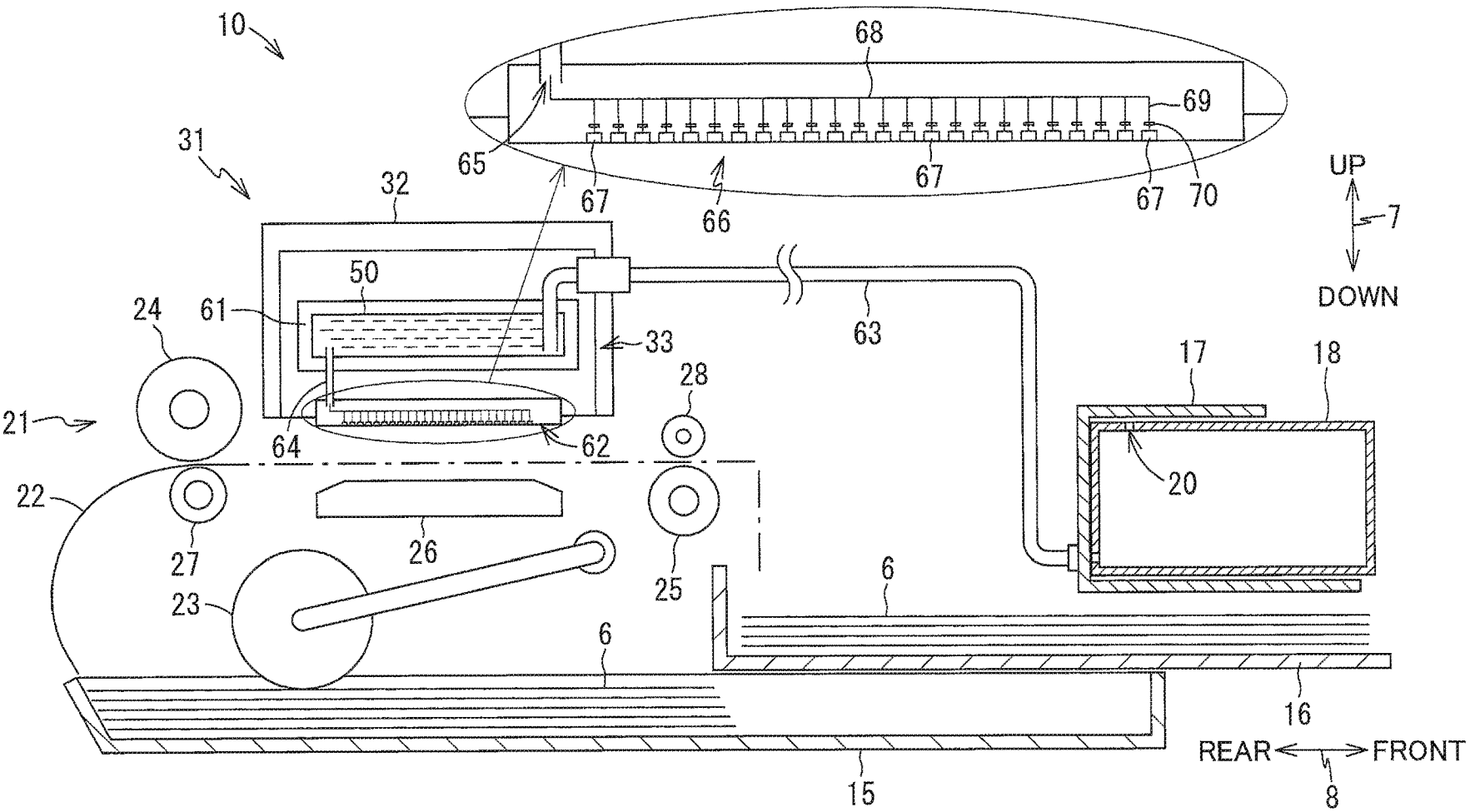
FIG. 2 is a vertical cross-sectional view schematically illustrating an internal configuration of the printer according to the embodiment.

Ink cartridges 18 (see FIG. 2) that store ink are provided in a housing 11 of the printer 10 rather than being mounted on a carriage 32 (see FIG. 2).

The printer 10 avoids situations in which the quantity of ink being supplied to the head 62 becomes insufficient while printing images on sheets 6. This aspect will be described later in greater detail.

As illustrated in FIGS. 1A and 1B, the printer 10 is provided with: the housing 11; and an operating panel 1; a feed tray 15; and a discharge tray 16 retained in the housing 11. In the example of the drawings, the operating panel 12 is disposed in the upper portion on a side surface of the housing 11. In the following description, the side surface of the housing 11 on which the operating panel 12 is provided will be called the front surface of the printer 10. The front surface of the printer 10 is used to define front/rear directions 8. The vertical direction in FIG. 1 defines up/down directions 7, while left/right directions 9 are defined as the directions orthogonal to the front/rear directions 8 and up/down directions 7. In the example of the drawings, the feed tray 15 and discharge tray 16 are positioned below the operating panel 12.

The operating panel 12 has a display 13, and operating buttons 14. The display 13 has a liquid crystal display (LCD) screen, and film-like transparent touch sensors overlaid on the LCD screen. In other words, the display 13 is known as a touchscreen. The user inputs print commands and other instructions into the printer 10 by touching the display 13 or pressing the operating buttons 14.

As illustrated in FIG. 2, the printer 10 also has: a mounting case 17 in which the ink cartridges 18 are mounted; a conveying device 21 that conveys the sheets 6; and a printing unit 31 that prints images by ejecting ink onto the conveyed sheets 6. The mounting case 17, conveying device 21, and printing unit 31 are all housed inside the housing 11. The conveying device 21 and printing unit 31 are examples of the printer of the present disclosure.

An opening 19 is formed in the front surface of the housing 11 (see FIG. 1B). The mounting case 17 is disposed inside the housing 11 and rearward of the opening 19. The mounting case 17 has retaining parts that detachably hold each of the ink cartridges 18. The number of retaining parts provided in the mounting case 17 conforms to the type of the printer 10. For example, when the printer 10 is a monochrome printer, the mounting case 17 is provided with a single retaining part enabling only one ink cartridge 18 storing black ink to be mounted in the mounting case 17. When the printer 10 is a color printer, the mounting case 17 is provided with a plurality of retaining parts, such as four retaining parts enabling four ink cartridges 18 storing black ink, cyan ink, magenta ink, and yellow ink, for example, to be mounted in the mounting case 17. The present embodiment will describe a color printer as an example of the printer 10. Hence, a plurality of ink cartridges 18 is mounted in the mounting case 17. In the printer 10 according to the present embodiment, the mounting case 17 has four retaining parts and four ink cartridges 18 are mounted in the mounting case 17. Note that the ink stored in the ink cartridges 18 may be dye-based ink or pigment ink.

The ink cartridges 18 all have the same configuration. Each ink cartridge 18 has a box-shape with interior space for storing ink. An air communication port 20 is formed in the top portion of the outer wall constituting the ink cartridge 18 for providing communication between the interior space and the exterior of the ink cartridge 18. In other words, the interior space of the ink cartridge 18 is open to the atmosphere. The ink cartridges 18 are examples of the receptacle of the present disclosure.

The conveying device 21 is provided primarily with: a conveying path 22 along which the sheets 6 are conveyed; a feed roller 23 that feeds sheets 6 accommodated in the feed tray 15 into the conveying path 22; a conveying roller 24 and a discharge roller 25 that convey the sheets 6 along the conveying path 22; and a platen 26 that supports the sheets 6 beneath the printing unit 31.

The conveying path 22 is a space defined by a plurality of pairs of guide members (not illustrated), for example. In the example of the drawings, the conveying path 22 forms a U-shaped path that proceeds upward from the rear end of the feed tray 15, then extends forward.

The platen 26 is a member that supports the sheets 6 while the printing unit 31 to be described later prints images on the sheets 6. The platen 26 is positioned above the feed tray 15.

The feed roller 23 is disposed in a position for contacting the sheets 6 loaded in the feed tray 15. By rotating, the feed roller 23 feeds the sheets 6 from the feed tray 15 into the conveying path 22.

The conveying roller 24 is rotatably supported in a frame (not illustrated) fixed to the housing 11. The conveying roller 24 is positioned rearward of the platen 26 in the front/rear directions 8. The conveying roller 24 configures a roller pair together with a pinch roller 27. When rotating, the conveying roller 24 conveys sheets 6 along the conveying path 22.

The discharge roller 25 is rotatably supported in the frame (not illustrated) fixed to the housing 11. The discharge roller 25 is positioned forward of the platen 26 in the front/rear directions 8. The discharge roller 25 configures a roller pair together with a spur roller 28. When rotating, the discharge roller 25 conveys sheets 6 along the conveying path 22 and discharges the sheets 6 into the discharge tray 16.

Figure 5:
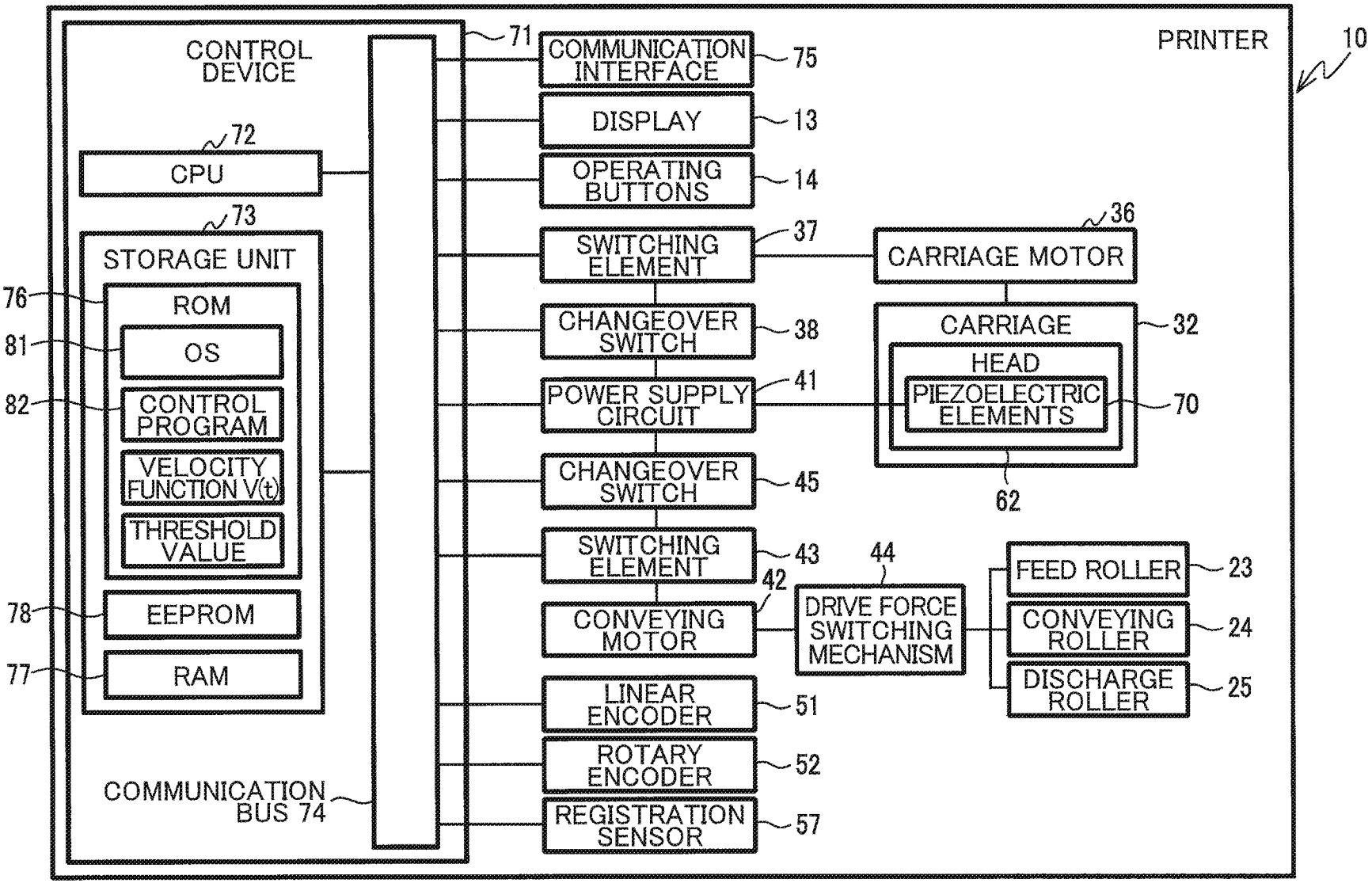
FIG. 5 is a functional block diagram of the printer including a control device according to the embodiment.

The feed roller 23, conveying roller 24, and discharge roller 25 are rotated by a conveying motor 42 (see FIG. 5). More specifically, the printer 10 is provided with the conveying motor 42, and a drive force switching mechanism 44, as illustrated in FIG. 5.

The conveying motor 42 is a DC motor that is driven to rotate when a DC voltage is supplied thereto. However, the conveying motor 42 may be an AC motor instead.

The drive force switching mechanism 44 is a gear change mechanism configured of a plurality of gears, such as a change gear and a gear train. The drive force switching mechanism 44 selectively transmits the rotational drive force of the conveying motor 42 to the feed roller 23, conveying roller 24, and discharge roller 25. Since the configuration of the drive force switching mechanism 44 is well known, a detailed description has been omitted here. Note that individual motors may be provided for rotating each of the feed roller 23, conveying roller 24, and discharge roller 25 without use of the drive force switching mechanism 44.

As illustrated in FIG. 2, the printing unit 31 is disposed above the platen 26. The printing unit 31 is provided with a carriage 32, and a printing part 33 mounted in the carriage 32.

Figure 3:
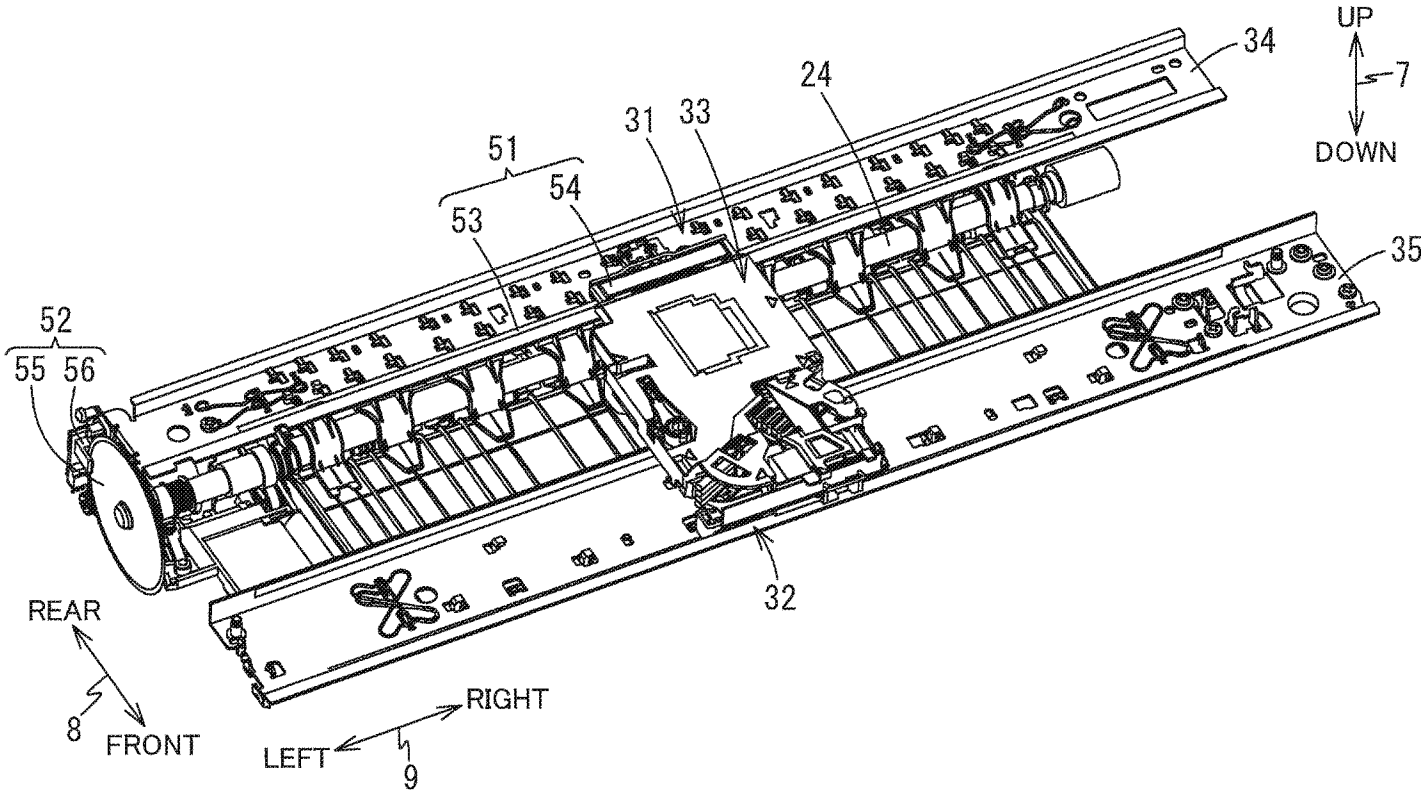
FIG. 3 is a perspective view of a printing unit provided in the printer according to the embodiment.

As illustrated in FIG. 3, the carriage 32 is supported by a pair of guide rails 34 and 35 so as to be movable along the left/right directions 9. The guide rails 34 and 35 both extend in the left/right directions 9 and are arranged apart from each other in the front/rear directions 8.

A moving device for moving the carriage 32 along the left/right directions 9 is provided in the printer 10. More specifically, the printer 10 is provided with a carriage motor 36 (see FIG. 5), a drive pulley driven to rotate by the carriage motor 36, a follow pulley forming a pair with the drive pulley, and an endless annular belt stretched around the drive pulley and follow pulley to configure the moving device. The carriage motor 36 is a DC motor that is driven to rotate when a DC voltage is supplied thereto. However, the carriage motor 36 may be an AC motor instead. The endless annular belt is also fixed to the carriage 32. The left/right directions 9 in which the carriage 32 moves are examples of the second direction of the present disclosure. The carriage motor 36 is an example of the drive source of the present disclosure.

When the carriage motor 36 drives the drive pulley to rotate, the drive pulley moves the endless annular belt. As a result, the carriage 32 fixed to the endless annular belt is moved along the left/right directions 9.

Figures 9A, 9B, 9C:
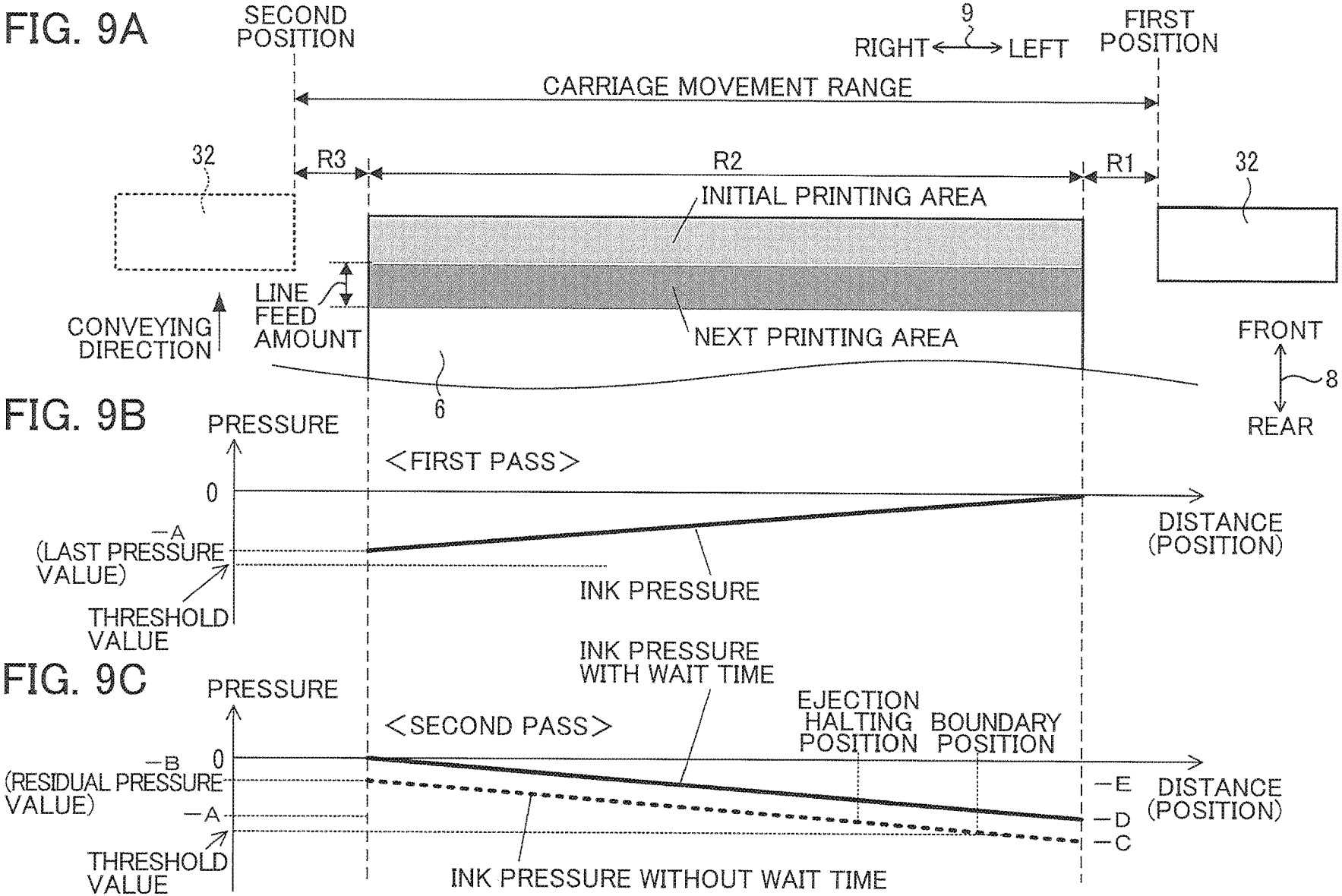
FIG. 9A is an explanatory diagram illustrating movement of a carriage in the printing unit of the printer according to the embodiment.
FIG. 9B is a graph illustrating relationship between a position of the carriage and ink pressure while the carriage moves from a first position to a second position.
FIG. 9C is a graph illustrating relationship between the position of the carriage and the ink pressure while the carriage moves from the second position to the first position.

The moving device described above reciprocates the carriage 32 between a first position and a second position illustrated in FIG. 9A. The first position denotes the position of the carriage 32 in the left part of the printer 10, and the second position denotes the position of the carriage 32 in the right part of the printer 10, for example. The carriage 32 is first accelerated from one of the first position and second position, and then maintained at a constant velocity, for example. Subsequently, the carriage 32 is decelerated before being halted at the other one of the first position and second position.

In FIG. 9A, the range in which the carriage 32 moves, i.e., the range between the first position and second position, is designated the "carriage movement range." The region in which the carriage 32 is accelerated during the movement of the carriage 32 from the first position to the second position, i.e., the "acceleration region" is designated as "R1" in FIG. 9A. The region in which the carriage 32 moves at a constant speed, i.e., the "constant velocity region" is designated as "R2" in FIG. 9A. The region in which the carriage 32 is decelerated during movement of the carriage 32 from the first position to the second position, i.e., the "deceleration region" is designated as "R3" in FIG. 9A. During the movement of the carriage 32 from the second position to the first position, on the other hand, the carriage 32 is accelerated in the region R3, moves at a constant speed in the region R2, and is decelerated in the region R1.

The carriage 32 opposes the sheet 6 while in the constant velocity region R2, but not while in the acceleration and deceleration regions R1 and R3. While the carriage 32 is moving at a constant velocity, a head 62 (described later) mounted on the carriage 32 ejects ink onto the printing area of the sheet 6 to print images in the printing area (scanning process). Subsequently, the conveying roller 24 conveys the sheet 6 a prescribed conveying amount (line feed amount; line feeding process). Thereafter, the carriage 32 is again moved between the first position and second position to print an image in the next printing area (scanning process). By alternately executing the scanning process and line feeding process, the carriage 32 prints an image over the entire surface of the sheet 6. This process will be described later in greater detail. Each printing area is an example of the printing area (first printing area and second printing area) of the present disclosure.

As illustrated in FIG. 2, the printing part 33 is provided with a buffer tank 61, and a head 62. The buffer tank 61 is formed in a box shape and has interior spaces for storing ink. The buffer tank 61 is connected to one end of each of four tubes 63. The other end of each tube 63 is connected to the mounting case 17. Hence, each interior space of the buffer tank 61 communicates with the interior space of the corresponding ink cartridge 18 mounted in the mounting case 17 via the corresponding tube 63. Ink stored in each ink cartridge 18 is supplied to the buffer tank 61 via the tube 63. The one end of the tube 63 is an example of the second end of the tube of the present disclosure. The other end of the tube 63 is an example of the first end of the tube of the present disclosure. The interior space of the tube 63 is an example of the channel of the present disclosure. Note that each tube 63 is flexible and bends as the carriage 32 moves.

The buffer tank 61 is connected to the head 62 by four channel members 64. The channel members 64 are pipes, for example, and one end (the top end) of each pipe is connected to the buffer tank 61 while the other end (the bottom end) is connected to the head 62. Ink in each color is supplied from the buffer tank 61 to the head 62 via each of the four channel members 64.

The top surface of the buffer tank 61 is open. A membrane sheet 50 is affixed to the top surface of the buffer tank 61. The membrane sheet 50 closes the opening in the top surface of the buffer tank 61.

The membrane sheet 50 has flexibility. The membrane sheet 50 flexes so as to expand upward when ink flows rapidly into the buffer tank 61 from the tube 63, and flexes so as to be recessed downward when ink flows rapidly out of the buffer tank 61 into the tube 63. By flexing in this way, the membrane sheet 50 can moderate sudden changes in ink pressure caused by ink flowing into and out of the buffer tank 61. Ink pressure denotes the pressure that ink exerts on the membrane sheet 50 on the buffer tank 61, and a manifold and nozzle channels 69 of the head 62 described later.

For example, inertial force acts on ink in the buffer tank 61 and tubes 63 owing to acceleration and deceleration of the carriage 32. This initial force acting on the ink causes ink to flow between each tube 63 and the buffer tank 61. In other words, the buffer tank 61 mitigates abrupt changes in ink pressure caused by the acceleration and deceleration of the carriage 32.

The head 62 is positioned below the buffer tank 61. The head 62 has four inflow ports 65 respectively connected to the bottom ends of the channel members 64. Ink of each color flows from the buffer tank 61 through corresponding one of the four channel members 64 into corresponding one of the four inflow ports 65.

Figure 4:
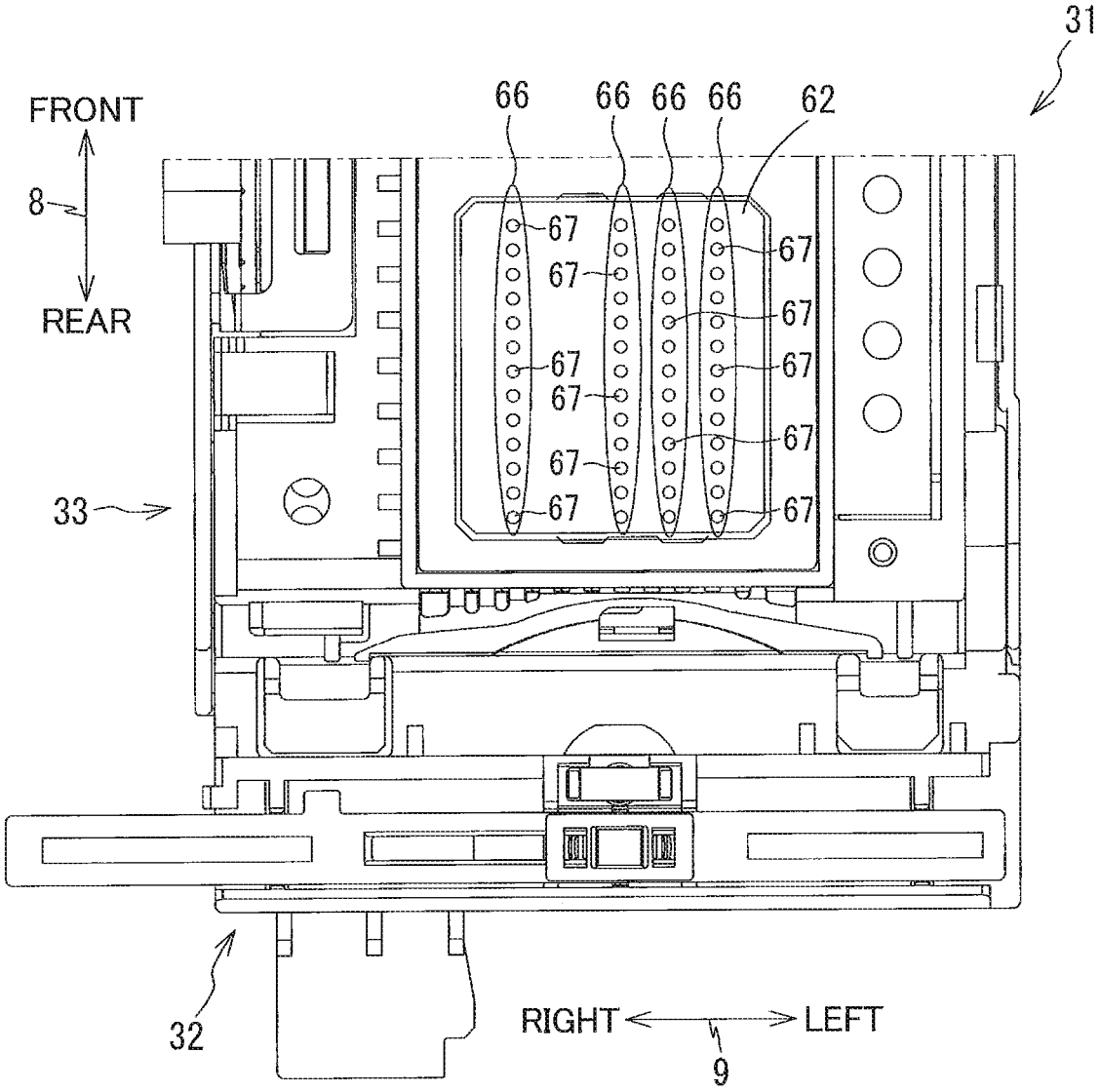
FIG. 4 is a bottom view of the printing unit having a carriage and a printing part provided in the printer according to the embodiment.

As illustrated in FIG. 4, the head 62 has four nozzle rows 66 that eject ink flowing in from the inflow ports 65. Each nozzle row 66 has a plurality of nozzles 67. Each nozzle row 66 ejects ink in one of the colors.

As illustrated in the enlarged view of FIG. 2, a single inflow port 65 is connected to a plurality of nozzles 67 in a single nozzle row 66 via a single manifold 68 and a plurality of nozzle channels 69. The structures of the manifold 68 and nozzle channels 69 are identical for each of the black, cyan, magenta, and yellow colors. Specifically, the manifold 68 and nozzle channels 69 that circulate black ink, the manifold 68 and nozzle channels 69 that circulate cyan ink, the manifold 68 and nozzle channels 69 that circulate magenta ink, and the manifold 68 and nozzle channels 69 that circulate yellow ink all have the same construction and are juxtaposed in the left/right directions 9 (the direction orthogonal to the paper surface on which FIG. 2 is drawn).

The manifold 68 extends forward in the front/rear directions 8 from the inflow port 65. The nozzle channels 69 extend downward from the manifold 68 to the bottom surface of the head 62. The openings in the nozzle channels 69 formed at the bottom surface of the head 62 constitute the nozzles 67.

The nozzle channels 69 are juxtaposed along the front/rear directions 8 and are separated from each other in the front/rear directions 8. The distance of separation between neighboring nozzle channels 69 is constant. In other words, the nozzles 67 in each nozzle row 66 are arranged at fixed intervals along the front/rear directions 8, as illustrated in FIG. 4.

As illustrated in FIG. 2, a piezoelectric element 70 is provided for each nozzle channel 69. Hence, the head 62 has a plurality of piezoelectric elements 70. The piezoelectric elements 70 deform in response to application of a DC voltage. By deforming, the piezoelectric element 70 applies pressure to ink in the corresponding nozzle channel 69, causing ink (an ink droplet) to be ejected from the corresponding nozzle 67. Lead zirconate titanate (PZT) or the like is used as the piezoelectric elements 70. The piezoelectric elements 70 is an example of the drive elements of the present disclosure. Note that heaters may be used in place of the piezoelectric elements 70 as drive elements that generate heat in response to supplied power. By generating heat, the heater rapidly vaporizes ink in the nozzle channel 69, causing ink (an ink droplet) to be ejected from the corresponding nozzle 67.

The positions of the nozzles 67 in the up/down directions 7 are higher than the levels of ink in the ink cartridges 18. Hence, atmospheric pressure does not cause ink to be ejected from the nozzles 67. The menisci of ink in the nozzles 67 prevent ink from flowing in reverse from the head 62 to the ink cartridges 18. That is, if ink menisci in the nozzles 67 break, air would be allowed to enter the head 62 through the nozzles 67, inhibiting the supply of ink from the ink cartridges 18 to the head 62.

The printer 10 is also provided with: a power supply circuit 41 that supplies power to the conveying motor 42, carriage motor 36, piezoelectric elements 70, and the like described above; a control device 71 that controls the drives of the conveying motor 42, carriage motor 36, and piezoelectric elements 70; and various sensors, switches, and the like. The control device 71 is an example of the control device of the present disclosure.

The power supply circuit 41 and control device 71 are implemented by: a control board; and ICs, microcomputers, coils, capacitors, resistors, and the like mounted on the control board, for example. That is, the printer 10 includes one or more control board units that implements the power supply circuit 41 and control device 71.

The power supply circuit 41 converts an inputted commercial AC voltage to DC voltage at a prescribed value. The power supply circuit 41 is formed in combination with a voltage regulator circuit or the like employing switching regulators, series regulators, or Zener diodes, for example. The DC voltage outputted by the power supply circuit 41 is supplied to the display 13, the control device 71, a communication interface 75 described later, the carriage motor 36, the conveying motor 42, and the like.

A changeover switch 38 and a switching element 37 are provided between the power supply circuit 41 and carriage motor 36. The changeover switch 38 switches the DC voltage supplied to the carriage motor 36 between positive and negative. That is, in response to a control signal inputted from the control device 71, the changeover switch 38 switches contacts in order to switch the DC voltage supplied to the carriage motor 36 between positive and negative. Switching the DC voltage supplied to the carriage motor 36 between positive and negative changes the direction in which the carriage motor 36 rotates. Changing the direction in which the carriage motor 36 rotates changes the direction in which the carriage 32 moves. In other words, the control device 71 controls the direction of movement for the carriage 32 by controlling the drive of the changeover switch 38.

The switching element 37 is a metal-oxide semiconductor field-effect transistor (MOSFET), for example. The switching element 37 is switched ON and OFF in response to a drive signal of constant frequency inputted from the control device 71. By changing the duty cycle of the constant frequency drive signal inputted into the switching element 37, the control device 71 controls the power (transferred electrical energy per unit time) supplied to the carriage motor 36. In other words, the control device 71 controls the rotational speed of the carriage motor 36 through pulse-width modulation (PWM) control. The control device 71 also controls driving of the switching element 37 and changeover switch 38 in order to rotate the carriage motor 36 or halt rotation of the carriage motor 36 and to control the rotation amount of the carriage motor 36 when driving the carriage motor 36 to rotate. By controlling the amount that the carriage motor 36 is rotated, the control device 71 can control the distance that the carriage 32 is moved.

Note that use of the changeover switch 38 and switching element 37 to control the rotating direction and rotational speed of the carriage motor 36 is just one example. Control of the rotating direction and rotational speed of the carriage motor 36 may be achieved using another method.

A changeover switch 45 and a switching element 43 are provided between the power supply circuit 41 and conveying motor 42. The changeover switch 45 switches the DC voltage supplied to the conveying motor 42 between positive and negative. That is, in response to a control signal inputted from the control device 71, the changeover switch 45 switches contacts in order to switch the DC voltage supplied to the conveying motor 42 between positive and negative. Switching the DC voltage supplied to the conveying motor 42 between positive and negative changes the direction in which the conveying motor 42 rotates.

The switching element 43 is a MOSFET, for example. As with the switching element 37, the control device 71 controls the rotational speed of the conveying motor 42 through PWM control. The control device 71 also controls driving of the switching element 43 and changeover switch 45 in order to rotate the conveying motor 42 or halt rotation of the conveying motor 42 and to control the rotation amount of the conveying motor 42 when driving the conveying motor 42 to rotate. By controlling the amount that the conveying motor 42 is rotated, the control device 71 can control the amount that the sheet 6 is conveyed.

Note that use of the changeover switch 45 and switching element 43 to control the rotating direction and rotational speed of the conveying motor 42 is just one example. Control of the rotating direction and rotational speed of the conveying motor 42 may be achieved using another method.

In order that the control device 71 can accurately control the conveyed amount and position of the sheet 6, the moving distance and position of the carriage 32, and the like, the printer 10 is provided with various sensors, including a linear encoder 51, a rotary encoder 52, and a registration sensor 57.

The linear encoder 51 is a sensor that detects the position of the carriage 32. As illustrated in FIG. 3, the linear encoder 51 is provided with a reading unit 53 disposed on the guide rail 34, and a photo-interrupter 54 disposed on the carriage 32. The reading unit 53 is configured of light-transmissive parts that transmit light, and light-shielding parts that block light arranged alternately along the left/right directions 9. The photo-interrupter 54 scans the reading unit 53 as the carriage 32 moves and outputs a pulse train configured of a plurality of pulses. The pulse train outputted by the photo-interrupter 54 is inputted into the control device 71, and the control device 71 controls the drive of the carriage motor 36 on the basis of the inputted pulse train.

The rotary encoder 52 is a sensor that detects the rotational speed and rotated amount of the conveying roller 24. The rotary encoder 52 is provided with an encoder disc 55 that rotates together with the conveying roller 24, and a photo-interrupter 56. The encoder disc 55 is configured of light-transmissive parts that transmit light, and light-shielding parts that block light arranged alternately along the circumferential direction. The photo-interrupter 56 scans the encoder disc 55 as the encoder disc 55 rotates and outputs a pulse train configured of a plurality of pulses. The pulse train outputted by the photo-interrupter 56 is inputted into the control device 71, and the control device 71 controls the drive of the conveying motor 42 on the basis of the inputted pulse train.

The registration sensor 57 illustrated in FIG. 5 is disposed to the rear of the conveying roller 24 (see FIG. 2) in the front/rear directions 8. That is, the registration sensor 57 is provided at a position upstream from the conveying roller 24 in the conveying direction of the sheet 6. The registration sensor 57 has a rotary member that rotates when pushed by a sheet 6 being conveyed along the conveying path 22, and a photo-interrupter that detects the rotated position of the rotary member, for example. The voltage of the signal outputted by the registration sensor 57 changes as the leading edge of the sheet 6 passes the registration sensor 57.

The signal outputted by the registration sensor 57 is inputted into the control device 71. The control device 71 counts the number of pulses outputted by the rotary encoder 52, beginning from the point that the voltage of the signal inputted from the registration sensor 57 changes, for example. The control device 71 identifies the position of the leading edge of the sheet 6 using the count (a cumulative value) of the number of pulses. The control device 71 uses signals inputted from the registration sensor 57 and rotary encoder 52 to execute a cueing process, for example. In the cueing process, the control device 71 conveys a sheet 6 until the leading edge of the sheet 6 has reached a prescribed cueing position opposing the head 62.

As illustrated in FIG. 5, the control device 71 is provided with a central processing unit (CPU) 72, a storage unit 73, and a communication bus 74. The communication bus 74 is connected to the CPU 72, storage unit 73, display 13, switching elements 37 and 43, power supply circuit 41, and a communication interface 75. The communication interface 75 establishes a connection with a communication circuit through use of a USB cable, a local area network (LAN) cable, wireless LAN, or the like. The communication circuit is the Internet, a LAN, or the like. The printer 10 communicates with servers, portable terminals, personal computers, or other devices via the communication interface 75. The printer 10 receives print commands via the communication interface 75 from the portable terminals and personal computers, for example.

The storage unit 73 is provided with a read only memory (ROM) 76, a random access memory (RAM) 77, and an electrically erasable and programmable ROM (EEPROM) 78. The ROM 76 stores an operating system (OS) 81, and a control program 82. The control program 82 may be a single program or an aggregate of programs. The control program 82 is configured by a user interface (UI) module that receives input operations from the user, a communication module that communicates with other devices via the communication interface 75, a power supply module that controls operations of the power supply circuit 41, and a print module that controls the conveying device 21 and printing unit 31. The CPU 72 executes the plurality of programs (modules) in a pseudo-parallel manner through multitasking, for example. The CPU 72 executing the control program 82 is an example of the controller of the present disclosure. The control program 82 is an example of the set of the program instructions of the present disclosure. The storage unit 73 is an example of the memory of the present disclosure.

Hereinafter, operations of the CPU 72 executing the control program 82 may be simply described as the operations of the control program 82. For example, the description that the control program 82 performs a process means that the CPU 72 executing the control program 82 performs the process.

The ROM 76 also stores a velocity function V(t) and a threshold value. The velocity function V(t) is used to control the velocity of the carriage 32 when accelerating the carriage 32, moving the carriage 32 at a constant velocity, or decelerating the carriage 32. More specifically, the control program 82 reads the velocity function V(t) from the storage unit 73. Next, the control program 82 drives the switching element 37 at a prescribed duty cycle. Subsequently, the control program 82 calculates the moving velocity of the carriage 32 on the basis of the pulse train inputted from the linear encoder 51. The control program 82 determines how much slower or faster the moving velocity at time t calculated for the carriage 32 (hereinafter called the "carriage velocity") is than the velocity at time t specified by the velocity function V(t) (hereinafter called the "target velocity"). If the control program 82 determines that the carriage velocity is slower than the target velocity, the control program 82 increases the duty cycle according to the difference between the carriage velocity and target velocity and drives the carriage motor 36 at the new duty cycle. If the control program 82 determines that the carriage velocity is faster than the target velocity, the control program 82 decreases the duty cycle according to the difference between the carriage velocity and target velocity and drives the carriage motor 36 at the new duty cycle. In other words, the control program 82 controls the amount of power supplied to the carriage motor 36 so that the carriage velocity matches the velocity specified by the velocity function V(t).

The threshold value is used for determining whether the quantity of ink supplied to the head 62 will be insufficient. This process will be described later in greater detail. Note that the velocity function V(t) and threshold value may be stored in the EEPROM 78 rather than the ROM 76. Further, the velocity function V(t) and threshold value are pre-stored in the storage unit 73 prior to shipping the printer 10.

The RAM 77 temporarily stores data and the like required for executing the OS 81 and control program 82. The EEPROM 78 stores data and the like that should be preserved when the power for the printer 10 is turned off, for example.

Next, the process executed by the control program 82 will be described with reference to FIGS. 6, 7A, 7B, 7C, 9A, 9B, and 9C. In this process, the control program 82 controls the head 62 to eject ink in order to print images on sheets 6 while preventing the quantity of ink being supplied to the head 62 from becoming insufficient.

Figure 6:
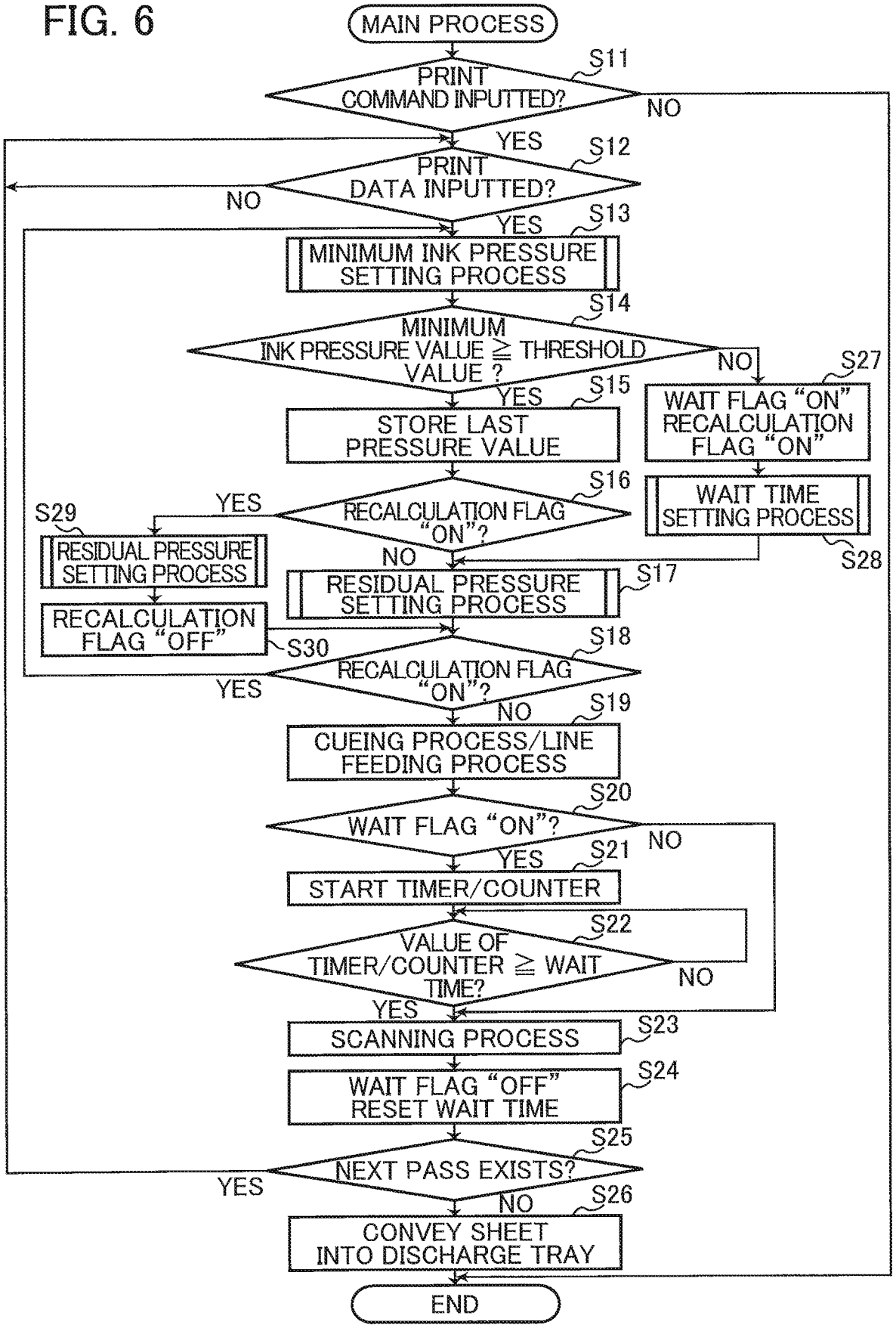
FIG. 6 is a flowchart illustrating steps in a main process executed by a CPU in the control device of the printer according to the embodiment.

The control program 82 executes the main process illustrated in FIG. 6. In S11 of the main process, the control program 82 determines whether a print command has been inputted. The user inputs a print command into the printer 10 using the touch sensors of the display 13 or the operating buttons 14 on the operating panel 12. Alternatively, the user may input a print command into the printer 10 via the communication interface 75 from a personal computer or a portable terminal.

If the control program 82 determines that a print command has not been inputted (S11: NO), the control program 82 ends the main process. When the control program 82 determines that a print command has been inputted (S11: YES), the control program 82 executes the process beginning from step S12. Note that the control program 82 executes the main process at fixed intervals, for example.

When the control program 82 determines that a print command has been inputted (S11: YES), in S12 the control program 82 determines whether print data has been inputted. The user inputs print data into the control device 71 via the communication interface 75 from a personal computer or a portable terminal, for example. Alternatively, the user may input the print data into the control device 71 from a portable storage medium, such as a USB memory mounted on the printer 10. When the printer 10 has a scanner, the print data may be inputted from the scanner as data for an image being copied. When the printer 10 has a fax function unit, the print data may be inputted from this fax function unit. The process to acquire print data in response to input of the print data in step S11: YES is an example of the (a) acquiring of the present disclosure.

The print data includes print settings and pass data. The print settings include settings for the type of paper, paper size, page orientation, and enlargement ratio, for example. The pass data represents an image to be printed in the printing area of the sheet 6 (see FIG. 9A) by moving the carriage 32 once from one of the first position and second position to the other of the first position and second position (hereinafter also called one pass worth of pass data). For example, the control program 82 sequentially acquires one pass worth of pass data from a personal computer, a portable terminal, or a USB memory. If the storage unit 73 has sufficient available capacity, the control program 82 may acquire pass data for a plurality of passes or pass data for a single page. Here, the term "pass" signifies movement of the carriage 32 from one of the first position and second position to the other of the first position and second position.

Next, the process beginning from step S13 will be described according to the example illustrated in FIGS. 9A to 9C. In the example of FIGS. 9A to 9C, first a cueing process (S19) is executed to convey the sheet 6 to a position in which the initial printing area on the leading edge of the sheet 6 opposes the head 62. Next, an image is printed in the initial printing area (the first pass) by ejecting ink from the head 62 while moving the carriage 32 from the first position to the second position. Subsequently, the sheet 6 is conveyed a line feed amount. The line feed amount is the distance that the sheet 6 must be moved for the next printing area to oppose the head 62. Next, an image is printed in the next printing area (the second pass) by ejecting ink from the head 62 while moving the carriage 32 from the second position to the first position. While printing images in the initial printing area and next printing area in the main process, the control program 82 controls the drives of the conveying motor 42, carriage motor 36, and piezoelectric elements 70 so that the quantity of ink supplied to the head 62 does not become insufficient.

A graph illustrated in FIG. 9B shows the relationship between the position of the carriage 32 and the pressure that ink exerts on the head 62 as ink is ejected from the head 62 while the carriage 32 moves from the first position to the second position. In the graph of FIG. 9B, the vertical axis represents pressure, and the horizontal axis indicates the position of the carriage 32. A graph illustrated in FIG. 9C shows the relationship between the position of the carriage 32 and the pressure that ink exerts on the head 62 as ink is ejected from the head 62 while the carriage 32 moves from the second position to the first position. In the graph of FIG. 9C, as with the graph of FIG. 9B, the vertical axis represents pressure, and the horizontal axis indicates the position of the carriage 32. Pressure is represented in the graphs of FIGS. 9B and 9C as a value based on atmospheric pressure being a zero reference. In other words, ink pressure that drops as ink is ejected from the head 62 is represented as negative pressure. Note that a "boundary position" and an "ejection halting position" illustrated in FIG. 9C will be described later in a fifth variation.

The control program 82 waits until print data is inputted (S12: NO). When the control program 82 determines that print data has been inputted (S12: YES), in S13 the control program 82 executes a minimum ink pressure setting process for setting the changes in ink pressure that will occur while printing is performed in the "initial printing area" and for identifying a minimum ink pressure value denoting the smallest ink pressure value while printing is performed in the "initial printing area". In this case, the control program 82 executes the minimum ink pressure setting process to set the ink pressure indicated by the solid line in the graph of FIG. 9B, and the minimum ink pressure value "−A".

Next, the drop in ink pressure will be described in greater detail. After a piezoelectric element 70 deforms and ink is ejected from the nozzle 67, the piezoelectric element 70 returns to its original shape. At this time, the ink pressure, i.e., the pressure that ink exerts on the manifold 68 and nozzle channel 69, drops. This drop in ink pressure draws ink from the ink cartridge 18 into the head 62 via the buffer tank 61 until the ink pressure is restored to its original pressure (atmospheric pressure). However, if the piezoelectric element 70 is continuously driven before the ink pressure is restored to its original pressure, the pressure gradually declines.

Here, the minimum ink pressure setting process will be described with reference to FIG. 7A. In S31 at the beginning of the process in FIG. 7A, the control program 82 determines whether the current pass is the initial pass. That is, the control program 82 determines whether the current print data is for printing an image in the "initial printing area".

If the current pass is the initial pass (S31: YES), in S32 the control program 82 sets a residual pressure value to zero. However, if the current pass is not the initial pass (S31: NO), in S33 the control program 82 acquires the residual pressure value by reading the value from the EEPROM 78 or RAM 77 of the storage unit 73. Here, the residual pressure value stored in the storage unit 73 may be set to an initial value of zero and, when the control program 82 determines that the current pass is the initial pass, the control program 82 may read this residual pressure value of zero. In this case, a process for overwriting the residual pressure value stored in the storage unit 73 with the initial value may be provided after step S25 described later at the end of the main process, for example.

Figure 7A:
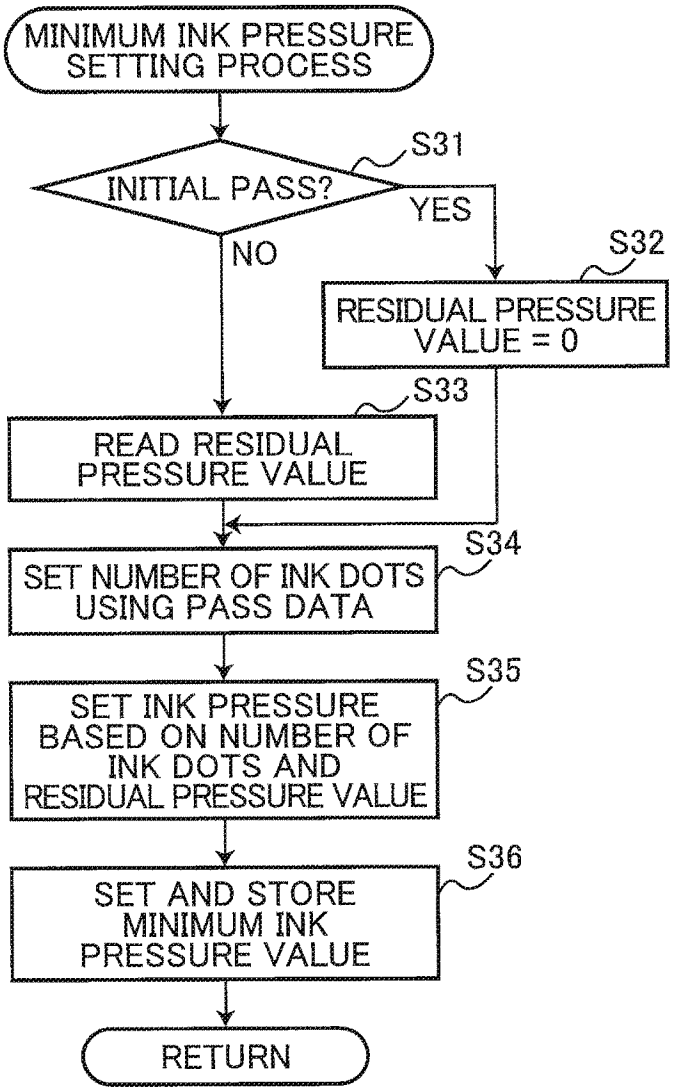
FIG. 7A is a flowchart illustrating steps in a minimum ink pressure setting process executed by the CPU in the control device of the printer according to the embodiment.

After the control program 82 has set the residual pressure value to zero (S32) or has read the residual pressure value from the storage unit 73 (S33), as illustrated in FIG. 7A, the control program 82 sets the drive count for each piezoelectric element 70 and the value of DC voltage to be supplied to each piezoelectric element 70 using the print data (pass data) acquired in S12. In S34 the control program 82 calculates and sets the number of ink dots in one pass for each nozzle row 66 on the basis of the drive count of the piezoelectric elements 70 and the voltage value supplied to the piezoelectric elements 70. The number of ink dots is a numerical value representing the total quantity of ink to be ejected by one nozzle row 66.

For example, the control program 82 calculates the number of ink dots to be the number of times DC voltage of a constant voltage value is supplied for driving the piezoelectric elements 70. More specifically, the control program 82 sets the value of DC voltage supplied to each piezoelectric element 70 to one of "large," "medium," and "small" on the basis of the pass data acquired in S12, for example. When DC voltage having the value "large" is supplied to the piezoelectric element 70, the nozzle 67 ejects a "large" ink droplet. When DC voltage having the value "medium" is supplied to the piezoelectric element 70, the nozzle 67 ejects a "medium" ink droplet. When DC voltage having the value "small" is supplied to the piezoelectric element 70, the nozzle 67 ejects a "small" ink droplet. Here, the "medium" ink droplet may be a % of the "large" ink droplet, and the "small" ink droplet may be b % of the "large" ink droplet ($0<b<a<100$). The control program 82 sets the number of ink dots to the number of "large" ink droplets to be ejected, assuming that all ink droplets are ejected as a "large" ink droplet in one pass. That is, the control program 82 calculates the number of ink dots by converting all ink droplets to be ejected by the nozzle 67 to "large" ink droplets.

In S35 the control program 82 uses the number of ink dots calculated in S34 and the residual pressure value acquired in S32 or S33 to set the ink pressure for the scanning process to be executed in S23 of FIG. 6.

More specifically, the control program 82 first determines the decline in pressure caused by ink being ejected from the head 62 (hereinafter called the "pressure drop") on the basis of the number of ink dots. For this purpose, a table storing correlations between numbers of ink dots and amounts of pressure drop or a formula for calculating the pressure drop from the number of ink dots may be stored in the ROM 76 or EEPROM 78 of the storage unit 73, for example. The control program 82 reads the pressure drop corresponding to the number of ink dots from the storage unit 73. Alternatively, the control program 82 calculates the pressure drop using the number of ink dots and the formula read from the storage unit 73. Note that there is no particular limitation on the method used for setting the pressure drop based on the number of ink dots, and a different method may be used to set the pressure drop.

In S35 the control program 82 sets the ink pressure by adding the residual pressure value acquired in S32 or S33 to the established pressure drop. Using the example illustrated in FIGS. 9A to 9C, in S35 the control program 82 sets the ink pressure as indicated by the solid line in the graph of FIG. 9B. Note that the pressure drop indicates a negative value when the pressure declines.

In S36 the control program 82 sets the minimum ink pressure value to the smallest ink pressure set in S35 and stores this value in the EEPROM 78 or RAM 77 of the storage unit 73. Subsequently, the control program 82 ends the minimum ink pressure setting process. In the example illustrated in FIG. 9B, the control program 82 stores "−A" in the storage unit 73 as the minimum ink pressure value. The ink pressure set in step S35 and the minimum ink pressure value set in step S36 are examples of the second ink pressure value of the present disclosure. The process for setting the ink pressure in step S35 and setting the minimum ink pressure value in step S36 is an example of the (f) setting of the present disclosure.

After executing the minimum ink pressure setting process of S13, in S14 of FIG. 6 the control program 82 determines whether the minimum ink pressure value set in the minimum ink pressure setting process of S13 is greater than or equal to the threshold value stored in the ROM 76 of the storage unit 73. The process in step S14 is an example of the (g) determining of the present disclosure. That the minimum ink pressure value is greater than or equal to the threshold value is an example that the second ink pressure value does not reach the threshold value of the present disclosure. That the minimum ink pressure value is less than the threshold value is an example that the second ink pressure value reaches the threshold value of the present disclosure.

Note that the process in steps S13 and S14 is executed for each of the ink colors black, cyan, magenta, and yellow. Hence, the ink pressure and minimum ink pressure value are set for all colors, and the control program 82 determines whether the minimum ink pressure value is greater than or equal to the threshold value for each of the colors. The control program 82 determines that the minimum ink pressure value is greater than or equal to the threshold value when the control program 82 determines in S14 that the minimum ink pressure value is greater than or equal to the threshold value for all colors of ink. The control program 82 determines in S14 that the minimum ink pressure value is less than the threshold value when the minimum ink pressure value is less than the threshold value for even one color.

The threshold value is set to a value at which the quantity of ink supplied to the head 62 becomes insufficient when the minimum ink pressure value drops to this threshold value. When ink supplied to the head 62 is insufficient, printing precision degrades because a suitable quantity of ink is not ejected from the head 62, and menisci of ink in the nozzles 67 break, allowing air to enter the head 62. Specifically, the threshold value is set to a value based on the diameter of the nozzles 67. For example, the threshold value (negative value) is set to smaller values for larger diameters of nozzles 67.

If the control program 82 determines that the minimum ink pressure value is greater than or equal to the threshold value (S14: YES), in S15 the control program 82 stores the last pressure value in the EEPROM 78 or RAM 77 of the storage unit 73. Specifically, the control program 82 sets the last value of ink pressure as the last pressure value according to the ink pressure set in S35 of the minimum ink pressure setting process and stores this last pressure value in the storage unit 73. In the example illustrated in FIGS. 9A to 9C, "−A" is stored in the storage unit 73 as the last pressure value.

After completing the process in S15, in S16 the control program 82 determines whether a recalculation flag is set to "ON". If the control program 82 determines that the recalculation flag is not set to "ON" (S16: NO), the control program 82 executes a residual pressure setting process in S17. The recalculation flag will be described later.

The residual pressure setting process is performed to set a residual pressure value. The residual pressure value will be described here with reference to FIGS. 9A to 9C. As described above, the last pressure value in the first pass is "−A". After completing the first pass and while the sheet 6 is being conveyed the line feed amount, movement of the carriage 32 is halted and ejection of ink from the head 62 is halted. By halting ejection of ink from the head 62, the ink pressure recovers from "−A" to "−B". "−B" is the residual pressure value for the second pass.

Next, the residual pressure setting process will be described with reference to FIG. 7C. In SM at the beginning of the process in FIG. 7C, the control program 82 sets a line feed time using the print data acquired in S12. The line feed time is the time required to convey the sheet 6 the line feed amount. For example, the control program 82 first sets a line feed amount for the sheet 6 on the basis of the acquired print data. The ROM 76 or EEPROM 78 of the storage unit 73 stores a table representing correlations between line feed amounts and line feed times, or a formula for calculating the line feed time from a line feed amount. The control program 82 then identifies the line feed time associated with the set line feed amount in the table stored in the storage unit 73 or uses the formula read from the storage unit 73 to calculate the line feed time based on the set line feed amount.

In S52 the control program 82 reads and acquires from the storage unit 73 the last pressure value stored in the storage unit 73 in S15 and a wait time stored in the storage unit 73 in S43 of a wait time setting process to be described later. Note that an initial value for the wait time is set to zero. Hence, if the wait time has not yet been set in the wait time setting process, the control program 82 reads the wait time of zero from the storage unit 73.

In S53 the control program 82 sets a recovery value based on the wait time read from the storage unit 73 and the line feed time set in S51. The recovery value specifies the amount that ink pressure will recover. More specifically, the control program 82 first adds the acquired wait time and line feed time to calculate a total time. The ROM 76 or EEPROM 78 of the storage unit 73 stores a table specifying correlations between total times and recovery values, or a formula for calculating the recovery value from a total time. The control program 82 identifies the recovery value in the table stored in the storage unit 73 that is associated with the calculated total time, or uses the formula read from the storage unit 73 to calculate the recovery value based on the calculated total time. The process for setting the recovery value in step S53 is an example of the (d) obtaining of the present disclosure.

As described above, the initial value of the wait time is zero. Hence, when the wait time has not yet been set in the wait time setting process to be described later, the control program 82 sets the recovery value based solely on the line feed time.

In S54 the control program 82 calculates the residual pressure value by adding the recovery value set in S53 to the last pressure value acquired in S52. Note that if the residual pressure value becomes a positive value, the value is set to zero as an upper limit.

In S55 the control program 82 stores the residual pressure value calculated in S54 in the EEPROM 78 or RAM 77 of the storage unit 73, and subsequently ends the residual pressure setting process. In the example of FIGS. 9A to 9C, the control program 82 stores "−B" in the storage unit 73 as the residual pressure value.

After completing the residual pressure setting process of S17, in S18 the control program 82 determines whether the recalculation flag is set to "ON". If the control program 82 determines that the recalculation flag is not set to "ON" (S18: NO), in S19 the control program 82 executes the cueing process.

The cueing process is performed to convey the sheet 6 to a position in which the "initial printing area" (see FIG. 9A) opposes the head 62. More specifically, the control program 82 sets a cueing amount using the print data acquired in S12. The cueing amount is the feed amount for feeding the sheet until the "initial printing area" reaches a position opposing the head 62.

The control program 82 then drives the conveying motor 42 to convey the sheet 6. The control program 82 stops driving the conveying motor 42 when a count value for pulses inputted from the rotary encoder 52 reaches a numerical value corresponding to the cueing amount set above.

After completing the cueing process of S19, the control program 82 executes a process from S20 to S22. This process will be described later.

After completing the process from S20 to S22, in S23 the control program 82 executes a scanning process for moving the carriage 32 from one of the first position and second position to the other of the first position and second position while ejecting ink from the head 62. In the example illustrated in FIG. 9A, ink is ejected onto the sheet 6 from the head 62 while moving the carriage 32 from the first position to the second position to print an image in the "initial printing area".

After the scanning process of S23, in S24 the control program 82 sets a wait flag to "OFF". Specifically, the control program stores "OFF" in a storage area of the EEPROM 78 allocated for the wait flag. Also in S24 the control program 82 resets the wait time to zero or overwrites the value stored as the wait time with "0". The wait flag and wait time will be described later.

In S25 the control program 82 determines whether a next pass exists. The existence of a next pass signifies that another printing area follows the current printing area in which an image was just printed. The control program 82 determines whether a next pass exists according to the print data acquired in S12.

If the control program 82 determines that a next pass does not exist (S25: NO), in S26 the control program 82 drives the discharge roller 25 via the conveying motor 42 to convey the sheet 6 into the discharge tray 16. Subsequently, the control program 82 ends the main process. Note that when the print command instructs the printing of a plurality of pages, after completing the process in S26, the control program 82 determines whether a next page exists and continues executing the process from S12 when a next page exists and continues executing the process beginning from S12 when a next page does exist.

When the control program 82 determines in S25 that a next pass exists (S25: YES), the control program 82 repeats the process beginning from S12. In the example illustrated in FIGS. 9A to 9C, the control program 82 determines that printing must be performed in the "next printing area" (that a next pass exists; S25: YES).

In S12 the control program 82 acquires print data that includes pass data for the second pass. In S13 the control program 82 sets the minimum ink pressure value. Specifically, the control program 82 uses the print data acquired in S12 and the residual pressure value "−B" that was stored in the storage unit 73 in S17 to set the ink pressure (S35) and the minimum ink pressure value (S36). In the example illustrated in FIGS. 9A to 9C, the control program 82 sets the ink pressure to the ink pressure depicted by the dashed line in the graph illustrated in FIG. 9C, and sets the minimum ink pressure value to "−C".

In S14 the control program 82 determines whether the minimum ink pressure value set in S13 is greater than or equal to the threshold value. In the example illustrated in the graph of FIG. 9C, the minimum ink pressure value "−C" is less than the threshold value illustrated in FIG. 9C. When the control program 82 determines that the minimum ink pressure value is less than the threshold value (S14: NO), in S27 the control program 82 sets the wait flag to "ON". Also in S27 the control program 82 sets the recalculation flag to "ON". Specifically, the control program 82 stores "ON" in a storage area of the EEPROM 78 allocated for the recalculation flag. Note that initial values for both the wait flag and the recalculation flag are set to "OFF".

In S28 the control program 82 executes the wait time setting process. The wait time setting process is performed to set a wait time. A wait time is the amount of time during which the carriage 32 is maintained in a halted state after the sheet 6 has been conveyed the line feed amount. The wait time setting process will be described next with reference to FIG. 7B.

Figure 7B:
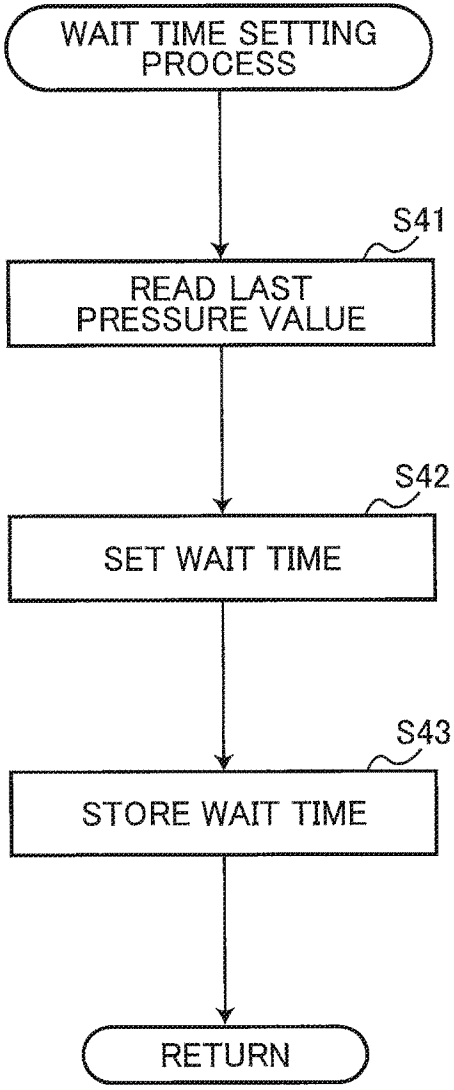
FIG. 7B is a flowchart illustrating steps in a wait time setting process executed by the CPU in the control device of the printer according to the embodiment.
Figure 7C:
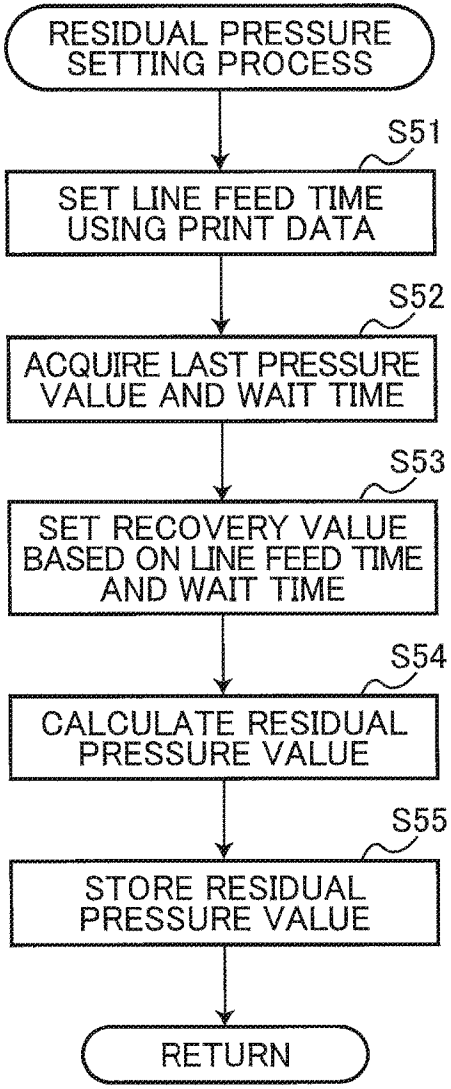
FIG. 7C is a flowchart illustrating steps in a residual pressure setting process executed by the CPU in the control device of the printer according to the embodiment.

In S41 at the beginning of the process in FIG. 7B, the control program 82 reads the last pressure value stored in the EEPROM 78 or RAM 77 of the storage unit 73 in S15. In the example illustrated in FIGS. 9A to 9C, the last pressure value read from the storage unit 73 is "−A".

In S42 the control program 82 sets the wait time based on the last pressure value read in S41. Specifically, the ROM 76 or EEPROM 78 of the storage unit 73 stores a table representing correlations between last pressure values and wait times or a formula for calculating the wait time from a last pressure value, for example. The control program 82 reads the wait time from the storage unit 73 that corresponds to the last pressure value, or uses the formula read from the storage unit 73 to calculate the wait time based on the last pressure value. The wait time is set longer for smaller last pressure values, for example. In other words, the wait time is increased for smaller last pressure values to allow for better recovery of ink pressure. Further, the pressure values set in the table and the formula stored in the storage unit 73 are configured to prevent the minimum ink pressure value from dropping below the threshold value in the scanning process executed in S22. The pressure values set in the table or the formula stored in the storage unit 73 are determined through tests and the like, for example.

The method of setting the wait time is not limited to the method described above, but may be another method for setting the wait time. For example, the control program 82 may read a wait time from the storage unit 73 as a fixed value pre-stored in the ROM 76 or EEPROM 78 of the storage unit 73. Alternatively, the control program 82 may read the residual pressure value stored in the storage unit 73 in S17 from the storage unit 73 instead of the last pressure value, and may set the wait time based on the residual pressure value. In this case, the storage unit 73 may store a table representing correlations between residual pressure values and wait times, or a formula for setting the wait time based on a residual pressure value in advance.

In S43 the control program 82 stores the wait time set in S42 in the EEPROM 78 or RAM 77 of the storage unit 73, and subsequently ends the wait time setting process.

As illustrated in FIG. 6, the control program 82 executes the residual pressure setting process in S17 after executing the wait time setting process in S28. In the example illustrated in FIGS. 9A to 9C, the control program 82 resets the residual pressure value using the wait time set in the wait time setting process of S28, the last pressure value "−A" stored in the storage unit 73, and the line feed time set in SM. In other words, the control program 82 sets the residual pressure value to which ink pressure will have been further restored from "−B" owing to the wait time. In the example illustrated in FIGS. 9A to 9C, the control program 82 sets the residual pressure value to "0".

After resetting the residual pressure value in S17, in S18 the control program 82 determines whether the recalculation flag is set to "ON". When determining that the recalculation flag is set to "ON" (S18: YES), in S13 the control program 82 re-executes the minimum ink pressure setting process. More specifically, the ink pressure changes from the ink pressure depicted by a dashed line in the graph of FIG. 9C to the ink pressure depicted by a solid line in the graph of FIG. 9C owing to the wait time. The control program 82 sets the ink pressure indicated by the solid line by re-executing the minimum ink pressure setting process in order to set the residual pressure value for the pass following the second pass. While not illustrated in the flowchart, the control program 82 determines whether a next pass (a third pass) exists according to the print data acquired in S12. When determining that a next pass does not exist, the control program 82 may execute the process beginning from the line feeding process of S19, without re-executing the minimum ink pressure setting process.

In the minimum ink pressure setting process re-executed in S13, the control program 82 sets the ink pressure and minimum ink pressure value using the residual pressure value of "0" reset in S17 and not the residual pressure value of "−B". In the example illustrated in FIGS. 9A to 9C, the control program 82 sets the pressure value as depicted by the solid line in the graph of FIG. 9C and sets the minimum ink pressure value to "−D".

In S14 the control program 82 determines whether the minimum ink pressure value set in S13 is greater than or equal to the threshold value. In the example illustrated in FIGS. 9A to 9C, the minimum ink pressure value of "−D" is greater than or equal to the threshold value. Thus, the control program 82 determines that the minimum ink pressure value is greater than or equal to the threshold value (S14: YES), and advances to S15. In S15 the control program 82 sets the last pressure value denoting the last established value of ink pressure, and stores this last pressure value in the storage unit 73. In the example of FIGS. 9A to 9C, the control program 82 stores "−D" in the storage unit 73 as the last pressure value.

After completing step S15, in S16 the control program 82 determines whether the recalculation flag is set to "ON". In other words, in S16 the control program 82 determines whether the last pressure value has been reset. When the control program 82 determines that the recalculation flag is set to "ON" (S16: YES), the control program 82 executes the residual pressure setting process in S29. The residual pressure setting process of S29 is the process for setting the residual pressure value by performing the residual pressure setting process illustrated in FIG. 7C with the value of the wait time being zero. Also, in S51 of the residual pressure setting process of S29, the control program 82 sets the line feed time required for the line feeding process to be executed after the second pass. In the example illustrated in FIGS. 9A to 9C, the control program 82 sets the residual pressure value to "−E". The residual pressure value of "−E" is calculated using the last pressure value reset in S15 and the recovery value based on the line feed time and wait time, and is used for setting ink pressure for the pass following the second pass (third pass).

After completing the process in S29, in S30 the control program 82 sets the recalculation flag to "OFF". Subsequently, in S18 the control program 82 determines whether the recalculation flag is set to "ON". When determining that the recalculation flag is not set to "ON" (S18: NO), in S19 the control program 82 executes the line feeding process. The line feeding process is performed to convey the sheet 6 to a position at which the next printing area (see FIG. 9A) opposes the head 62. More specifically, the control program 82 sets the line feed amount using the print data acquired in S12. The line feed amount is the conveying amount for conveying the sheet 6 to a position at which the next printing area opposes the head 62.

The control program 82 drives the conveying motor 42 to convey the sheet 6 and stops driving the conveying motor 42 when the count of pulses inputted from the rotary encoder 52 reaches a numerical value equivalent to the line feed amount.

After completing the line feeding process of S19, in S20 the control program 82 determines whether the wait flag is set to "ON". In other words, in S20 the control program 82 determines whether a wait time has been set.

When the control program 82 determines that the wait flag is set to "ON" (S20: YES), in S21 the control program 82 starts a timer/counter. In S22 the control program 82 determines whether the value of the timer/counter has reached the wait time set in S42. The control program 82 continues to wait before executing the scanning process of S23 while the value of the timer/counter has not reached the wait time (S22: NO).

Once the control program 82 determines that the value of the timer/counter has reached the wait time (S22: YES), in S23 the control program 82 executes the scanning process.

Note that the control program 82 skips the process in S21 and S22 when determining in S20 that the wait flag is not set to "ON" (S20: NO). In other words, when the wait flag is set to "OFF", the control program 82 immediately moves the carriage 32 after executing the line feeding process of S19, without maintaining the carriage 32 in a halted state during a wait time.

The scanning process in step S22 is an example of the (b) executing of the present disclosure. The scanning process in step S23 which is executed subsequent to maintaining the carriage 32 in a halted state for a period equivalent to a wait time after completing the line feed process in step S19 is an example of the second mode of print of the present disclosure. The scanning process in step S23 which is executed subsequent to the line feed process without maintaining the carriage 32 in a halted state during a wait time is an example of the first mode of print of the present disclosure.

After completing the scanning process in S23, the control program 82 executes the process in steps S24, S25, and S26 described above.

<Effects of the Embodiment>

The control device 71 sets an ink pressure indicating the pressure that ink exerts on the head 62 using acquired print data and an established residual pressure value. Hence, the control device 71 can set the ink pressure more accurately than when setting ink pressure without using a residual pressure value. Thus, the control device 71 can set the ink pressure accurately without using pressure sensors. Since the control device 71 can set the ink pressure accurately, the control device 71 can accurately determine whether the quantity of ink supplied to the head 62 will become insufficient.

Further, the control device 71 executes the scanning process without implementing a wait time (the first mode of print) when the minimum ink pressure value denoting the minimum value of the established ink pressure is greater than or equal to a threshold value, and executes the scanning process with an established wait time (the second mode of print) when the minimum ink pressure value is less than the threshold value. The threshold value is set to such a value that the quantity of ink supplied to the head 62 will be insufficient when the minimum ink pressure value is less that the threshold value. In other words, the threshold value is set to such a value that the quantity of ink supplied to the head 62 will not be insufficient when the minimum ink pressure value is greater than or equal to the threshold value. Hence, the control device 71 can change the mode of printing being executed between cases in which the quantity of ink supplied to the head 62 is sufficient and cases in which the quantity of ink supplied to the head 62 is insufficient.

In the present embodiment, a wait time is set when the minimum ink pressure value is less than the threshold value indicating that the quantity of ink supplied to the head 62 will become insufficient, and the carriage 32 is kept halted for a period equivalent to the wait time after the line feeding process is executed. Hence, the ink supply to the head 62 can be prevented from becoming insufficient better than if the carriage 32 were not maintained in a halted state during a wait time. Thus, the present embodiment can prevent a drop in printing precision or can prevent ink menisci in the nozzle 67 from breaking.

In the present embodiment, the control device 71 also sets a recovery value based on the line feed time. Therefore, a recovery value can be set more accurately than when the recovery value is a predetermined fixed value. By setting the recovery value accurately, the control device 71 can set the residual pressure value accurately. Since the control device 71 can set an accurate residual pressure value, the control device 71 can accurately determine whether the ink supply to the head 62 will become insufficient. Thus, the present embodiment can further suppress a drop in printing precision due to an insufficient quantity of ink supply to the head 62, or can further suppress ink menisci in the nozzles 67 from breaking.

In the present embodiment, the control device 71 also sets a recovery value based on the wait time and the line feed time. Hence, the recovery value can be set more accurately than when the control device 71 sets the recover value based solely on the line feed time and not on the wait time. Since the control device 71 can set an accurate recovery value, the control device 71 can set an accurate residual pressure value. Since the control device 71 can set an accurate residual pressure value, the control device 71 can accurately determine whether the quantity of ink supplied to the head 62 will become insufficient. Thus, the present embodiment can further suppress a drop in printing precision due to an insufficient ink supply to the head 62, or can further suppress ink menisci in the nozzles 67 from breaking.

In the present embodiment, the control device 71 also sets a wait time using the last pressure value (S41, S42). If the wait time were a predetermined fixed value, the ink pressure might not recovery sufficiently or the carriage 32 might be kept halted even after the ink pressure has recovered to the upper limit of zero. By setting a wait time using the last pressure value, the control device 71 can set the wait time so that the ink pressure recovers to a pressure that supplies a sufficient quantity of ink to the head 62, and can set the wait time so that the carriage 32 is not kept halted after the ink pressure has recovered to the upper limit of zero. Thus, the present embodiment can prevent a drop in printing precision and prevent ink menisci in the nozzles 67 from breaking while preventing the time required for printing from becoming excessively long.

<First Variation>

The embodiment provided above describes an example in which the carriage 32 is kept halted during a wait time following execution of the line feeding process. This variation will describe a case in which stoppage time of the carriage 32 after the carriage 32 arrives at the first position or the second position and until the next movement begins is set as the wait time. For example, when a blank space is present in the image being printed, the line feed amount is increased to an amount equivalent to the blank space, thereby lengthening the time required for the line feeding process, i.e., a line feed time. When the line feed time is increased, it is likely that the ink pressure will have recovered sufficiently after the line feeding process has completed. Consequently, the time required for printing may be increased unnecessarily by an amount equivalent to the wait time. In the present variation, the stoppage time of the carriage 32 from the time that the carriage 32 reaches the first position or the second position and until the next movement of the carriage 32 begins is set as the wait time, and movement of the carriage 32 is begun immediately after execution of the line feeding process when the line feed time is longer than the wait time. If the line feed time is shorter than the wait time, the next movement (next pass) of the carriage 32 is begun after the carriage 32 has been halted for a period equivalent to the wait time. This process will be described in detail below.

In the first variation, the control program 82 executes the following process in place of steps S21 and S22 of the main process in FIG. 6 described in the embodiment.

After completing the scanning process in S23, i.e., after movement of the carriage 32 is halted, the control program 82 begins measuring time with a timer/counter. When the control program 82 determines that a next pass exists (S25: YES), the control program 82 repeats the process from S12 to S19. After completing the line feed process in S19, in S20 the control program 82 subsequently determines whether the wait flag is set to "ON". If the control program 82 determines in S20 that the wait flag is set to "ON", the control program 82 further determines whether the count value of the timer/counter is greater than or equal to the wait time. In other words, the control program 82 determines whether the stoppage time of the carriage 32 is greater than or equal to the established wait time at the moment the line feeding process of S19 has ended. If the control program 82 determines that the count value of the timer/counter is less than the wait time, the control program 82 maintains the carriage 32 in a halted state, and waits until the count value reaches the wait time. If the control program 82 determines that the count value is greater than or equal to the wait time, the control program 82 begins moving the carriage 32 and executes the scanning process of S23.

In this variation, the control program 82 moves the carriage 32 immediately after the line feeding process when the ink pressure has sufficiently recovered by maintaining the carriage 32 in a halted state for the line feed time, which is the time required to complete the line feeding process. Therefore, the control device 71 can prevent the ink supply to the head 62 from becoming insufficient while preventing the time required for printing from becoming excessively long.

<Second Variation>

The embodiment provided above describes an example in which ink is ejected from the head 62 in order to print an image on the sheet 6 during the constant velocity region, which is the region in which the carriage 32 moves at a constant speed. This variation will describe a case in which ink is ejected from the head 62 in order to print an image on the sheet 6 during the acceleration region R1 in which the carriage 32 is accelerated, the constant velocity region R2 in which the carriage 32 moves at a constant speed, and the deceleration region R3 in which the carriage 32 is decelerated, as illustrated in FIGS. 10A to 10D. Note that the carriage 32 moves from the first position to the second position in the example of FIGS. 10A to 10D.

When the carriage 32 is accelerated or decelerated (hereinafter also called "acceleration/deceleration"), an inertial force is applied to ink in the head 62 and the tube 63. This inertial force causes ink to flow out of the head 62 into the tube 63 or to flow into the head 62 from the tube 63. Ink pressure drops when ink flows out of the head 62 into the tube 63 and rises when ink flows into the head 62 from the tube 63. If ink is ejected from the head 62 after ink pressure has dropped, the quantity of ink supplied to the head 62 may be insufficient, resulting in a drop in printing precision or breakage of ink menisci in the nozzles 67.

Figure 8A:
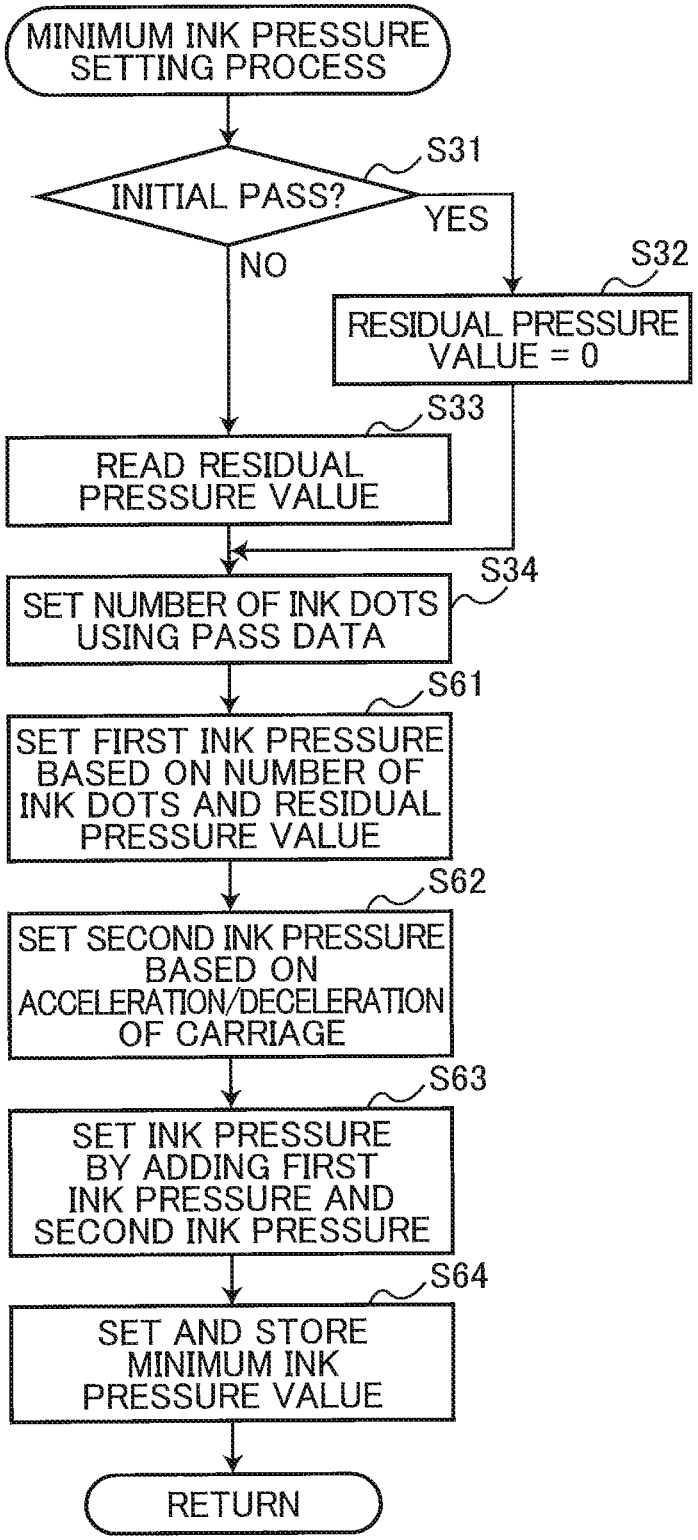
FIG. 8A is a flowchart illustrating steps in a minimum ink pressure setting process executed by a CPU in a control device of a printer according to a second variation.

In this variation, the control program 82 sets the ink pressure and a minimum ink pressure value according to the acceleration/deceleration of the carriage 32 in addition to the acquired print data (pass data) and the residual pressure value. Specifically, the control program 82 executes the minimum ink pressure setting process illustrated in FIG. 8A in place of the minimum ink pressure setting process illustrated in FIG. 7A. This process is described next in detail, while a description about the configuration in this variation that are equivalent to the configuration in the embodiment has been omitted here.

Figure 10A:
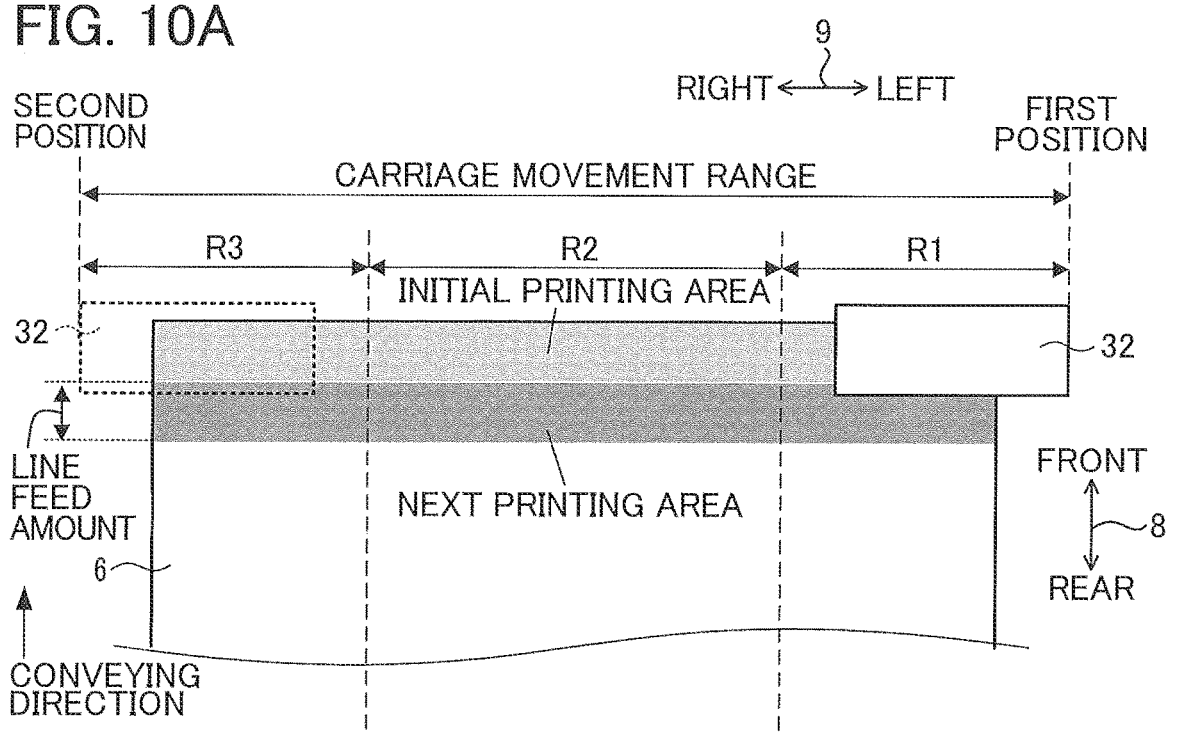
FIG. 10A is an explanatory diagram illustrating movement of a carriage in the printing unit of the printer according to the second variation.
Figure 10B:
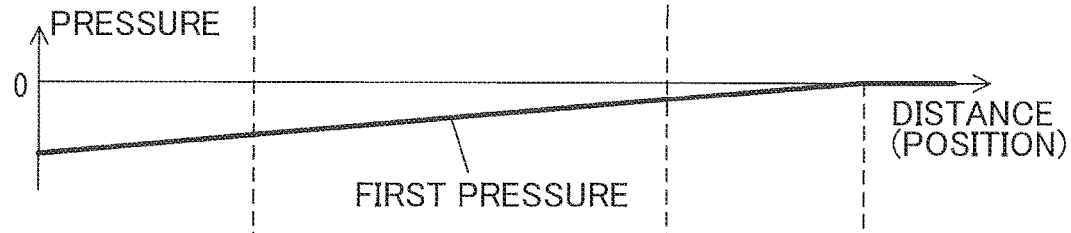
FIG. 10B is a graph illustrating relationship between a position of the carriage and a first pressure while the carriage moves from a first position to a second position.
Figure 10C:
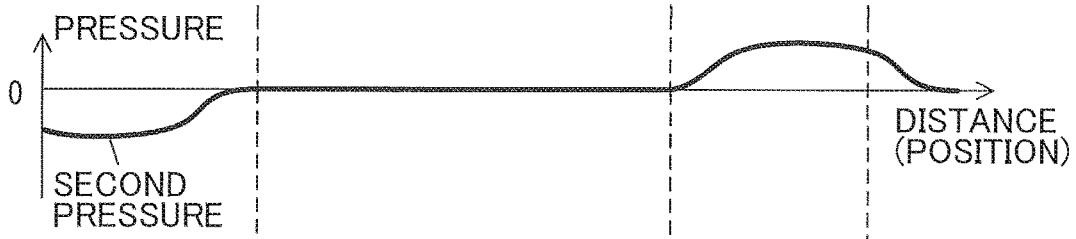
FIG. 10C is a graph illustrating relationship between the position of the carriage and a second pressure while the carriage moves from the first position to the second position.
Figure 10D:
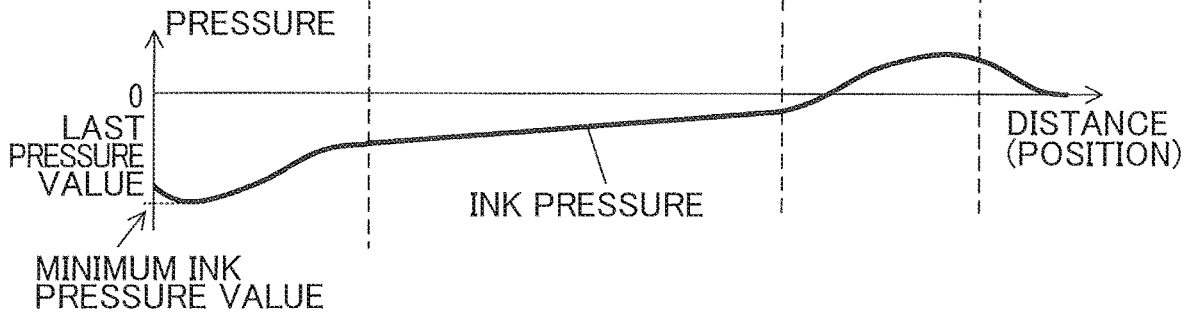
FIG. 10D is a graph illustrating relationship between the position of the carriage and ink pressure while the carriage moves from the first position to the second position.

The direction in which the carriage 32 is moved and whether the carriage 32 is accelerated or decelerated determines whether ink flows out of the head 62 to the tube 63 or flows into the head 62 from the tube 63. Thus, the control program 82 determines whether ink flows out of the head 62 to the tube 63 or flows into the head 62 from the tube 63 on the basis of the direction in which the carriage 32 moves and whether the carriage 32 is accelerated or decelerated. In the example illustrated in FIGS. 10A to 10D, ink flows from the tube 63 into the head 62 when the carriage 32 is accelerated from the first position toward the second position, and ink flows out of the head 62 toward the tube 63 when the carriage 32 is decelerated toward the second position. Note that the vertical axis and horizontal axis of the graph and the reference value for pressure (zero) illustrated in FIGS. 10B to 10D are all identical to those in the graph of FIGS. 9B and 9C.

As in the embodiment, the control program 82 executes the process from S31 to S34 to acquire the residual pressure value and the number of ink dots. In S61 of FIG. 8A, the control program 82 sets a first pressure on the basis of the acquired residual pressure value and number of ink dots. The first pressure is set in the same way that ink pressure is set in the embodiment. That is, the control program 82 sets the first pressure in S61 to a pressure equivalent to a pressure drop (partial pressure) caused by ink ejection from the head 62. The first pressure is depicted in the graph of FIG. 10B.

In S62 the control program 82 sets a second pressure indicating a pressure equivalent to a change in ink pressure due to acceleration/deceleration of the carriage 32 determined by the velocity function V(t). The second pressure indicates the pressure after ink pressure is moderated by the membrane sheet 50 described above. The control program 82 sets the second pressure by reading a second pressure from the storage unit 73, for example. The ROM 76 or EEPROM 78 of the storage unit 73 stores two tables including a first table and a second table. The first table specifies correlations between positions of the carriage 32 in the acceleration region and second pressures, and the second table specifies correlations between positions of the carriage 32 in the deceleration region and second pressures. Alternatively, the control program 82 calculates an acceleration function A(t) by taking the derivative of the velocity function V(t) and calculates the second pressure by multiplying a prescribed coefficient by an acceleration A(t1) at a position x(t1) of the carriage 32 for a time tl according to the calculated acceleration function A(t). The prescribed coefficient is stored in the storage unit 73 prior to shipping the printer 10. The second pressure is depicted in the graph of FIG. 10C.

In S63 the control program 82 finds a total ink pressure by adding the first pressure (partial pressure) to the second pressure (partial pressure) determined in S61 and S62 and sets the ink pressure to this total pressure. In S64 the control program 82 sets the minimum ink pressure value to the smallest value in the established ink pressure set in S63. The control program 82 stores the minimum ink pressure value in the EEPROM 78 or RAM 77 of the storage unit 73. Subsequently, the control program 82 ends the minimum ink pressure setting process. The ink pressure is depicted in the graph of FIG. 10D.

After completing the minimum ink pressure setting process, the control program 82 determines whether the minimum ink pressure value set in S64 is greater than or equal to the threshold value (S14 of FIG. 6) and continues executing the process beginning from S15 when the minimum ink pressure value is greater than or equal to the threshold value (S14: YES).

<Effects of the Second Variation>

In the variation described above, the ink pressure and minimum ink pressure value are set on the basis of acceleration/deceleration of the carriage 32 in addition to the print data (pass data) and the residual pressure value. Hence, for a printer 10 that prints images on sheets 6 by ejecting ink from the head 62 even in acceleration/deceleration regions R1 and R3 of the carriage 32, the control device 71 can set more accurate ink pressures and minimum ink pressure values than when ink pressure is not set on the basis of the acceleration/deceleration of the carriage 32. Since the control device 71 can set an accurate minimum ink pressure value, the control device 71 can more accurately determine whether the ink supply to the head 62 will become insufficient. Thus, this variation can prevent a drop in printing precision or can prevent ink menisci in the nozzles 67 from breaking and allowing air into the head 62 for a printer 10 that prints images on sheets 6 by ejecting ink from the head 62 even in acceleration/deceleration regions R1 and R3 of the carriage 32.

<Third Variation >

The embodiment provided above describes an example in which the ink pressure and minimum ink pressure value are set on the basis of the number of ink dots and the residual pressure value. This variation describes a case in which the ink pressure and minimum ink pressure value are set on the basis of the velocity of the carriage 32 in addition to the number of ink dots and the residual pressure value.

In the third variation, the ROM 76 or EEPROM 78 of the storage unit 73 stores a first velocity function V1(t) and a second velocity function V2(t) in place of the velocity function V(t) in the embodiment. The first velocity function V1(t) is the same velocity function as the velocity function V(t) in the embodiment. The second velocity function V2(t) is a function for moving the carriage 32 at a slower speed than the speed at which the first velocity function V1(t) moves the carriage 32.

In the present variation, the print data acquired by the control program 82 in S12 of the main process of FIG. 6 includes a print setting indicating either "normal print" or "high-quality print." The ROM 76 or EEPROM 78 of the storage unit 73 stores "normal print" in correlation with the "first velocity function V1(t)" and stores "high-quality print" in correlation with the "second velocity function V2(t)." When the print data acquired in S12 includes "normal print," the control program 82 reads the first velocity function V1(t) from the storage unit 73. When the print data includes "high-quality print," the control program 82 reads the second velocity function V2(t) from the storage unit 73. In the scanning process of S23, the control program 82 accelerates, moves at a constant speed, and decelerates the carriage 32 using the velocity function read from the storage unit 73 to move the carriage 32 from one of the first position and second position to the other. The process in which the control program 82 reads the first velocity function V1(t) or the second velocity function V2(t) and sets the moving velocity of the carriage 32 is an example of the (j) setting of the present disclosure.

In S35 of the minimum ink pressure setting process illustrated in FIG. 7A, the control program 82 sets the ink pressure on the basis of the carriage velocity specified by the velocity function read from the storage unit 73 in addition to the number of ink dots and the residual pressure value. In more detail, the degree to which ink pressure drops is dependent on the frequency of ink ejection (also known as the printing duty cycle), i.e., the quantity of ink ejected per unit time. Specifically, the drop in ink pressure is larger when ink is ejected more frequently and smaller when ink is ejected less frequently. The frequency of ink ejection is dependent on carriage velocity. That is, ink is ejected more frequently when the carriage velocity is high and less frequently when the carriage velocity is low.

The control program 82 sets the frequency of ink ejection for one pass on the basis of the number of ink dots and the carriage velocity. Specifically, the ROM 76 or EEPROM 78 of the storage unit 73 stores either a table specifying correlations between numbers of ink dots, carriage velocities, and ink ejection frequencies, or a formula for calculating the frequency of ink ejection from the number of ink dots and the carriage velocity. When the storage unit 73 stores a table, the control program 82 selects the frequency of ink ejection in the table that corresponds to the number of ink dots and the carriage velocity. When the storage unit 73 stores a formula, the control program 82 uses the formula read from the storage unit 73 to calculate the ink ejection velocity based on the number of ink dots and the carriage velocity.

The control program 82 sets a pressure drop denoting the degree of drop in ink pressure on the basis of the frequency of ink ejection set above. More specifically, the ROM 76 or EEPROM 78 of the storage unit 73 stores either a table specifying correlations between ink ejection frequencies and pressure drops, or a formula for calculating the pressure drop from the frequency of ink ejection. When the storage unit 73 stores a table, the control program 82 selects the pressure drop in the table that corresponds to the frequency of ink ejection. When the storage unit 73 stores a formula, the control program 82 uses the formula to calculate the pressure drop based on the frequency of ink ejection. Note that the ROM 76 or EEPROM 78 of the storage unit 73 may also store either a table specifying correlations between numbers of ink dots, carriages velocities, and pressure drops, or a formula for calculating the pressure drop from the number of ink dots and the carriage velocity. When the storage unit 73 stores a table, the control program 82 selects the pressure drop in the table that corresponds to the number of ink dots and the carriage velocity. When the storage unit 73 stores a formula, the control program 82 uses the formula to calculate the pressure drop based on the number of ink dots and the carriage velocity.

The control program 82 calculates and sets the ink pressure by adding the residual pressure value to the established pressure drop. Subsequently, the control program 82 sets the minimum ink pressure value based on the ink pressure set above.

<Effects of the Third Variation>

In this variation, the ink pressure and minimum ink pressure value are set using the carriage velocity, as well as the number of ink dots and the residual pressure value. Hence, for a printer 10 that has a selectable carriage speed, this variation can set more accurate ink pressures and minimum ink pressure values than when setting the ink pressure and minimum ink pressure value without using the carriage velocity. Since the control device 71 can set an accurate minimum ink pressure value, the control device 71 can accurately determine whether the quantity of ink supplied to the head 62 will become insufficient. Thus, the control device 71 can further suppress a drop in printing precision or can further suppress breakage of ink menisci in the nozzles 67 caused by an insufficient supply of ink to the head 62.

<Fourth Variation>

The embodiment provided above describes an example in which the quantity of ink supplied to the head 62 is prevented from becoming insufficient by setting a wait time and maintaining the carriage 32 in a halted state for the duration of the wait time when the minimum ink pressure value is less than the threshold value. This variation describes a case in which one printing area is printed by reciprocating the carriage 32 between the first position and second position when the minimum ink pressure value is less than the threshold value. Specifically, when the minimum ink pressure value is greater than or equal to the threshold value, an image is printed in a printing area by ejecting ink in the printing area while moving the carriage 32 once from one of the first position and second position to the other of the first position and second position (one pass). When the minimum ink pressure value is less than the threshold value, part of the image to be printed in the printing area is printed by moving the carriage 32 from one of the first position and second position to the other of the first position and second position, and subsequently the remaining part of the image to be printed in the printing area is printed by moving the carriage 32 back to the starting position (that is, moving the carriage from the other of the first position and second position to the one of the first position and second position; two passes) without executing a line feeding process.

Figure 11:
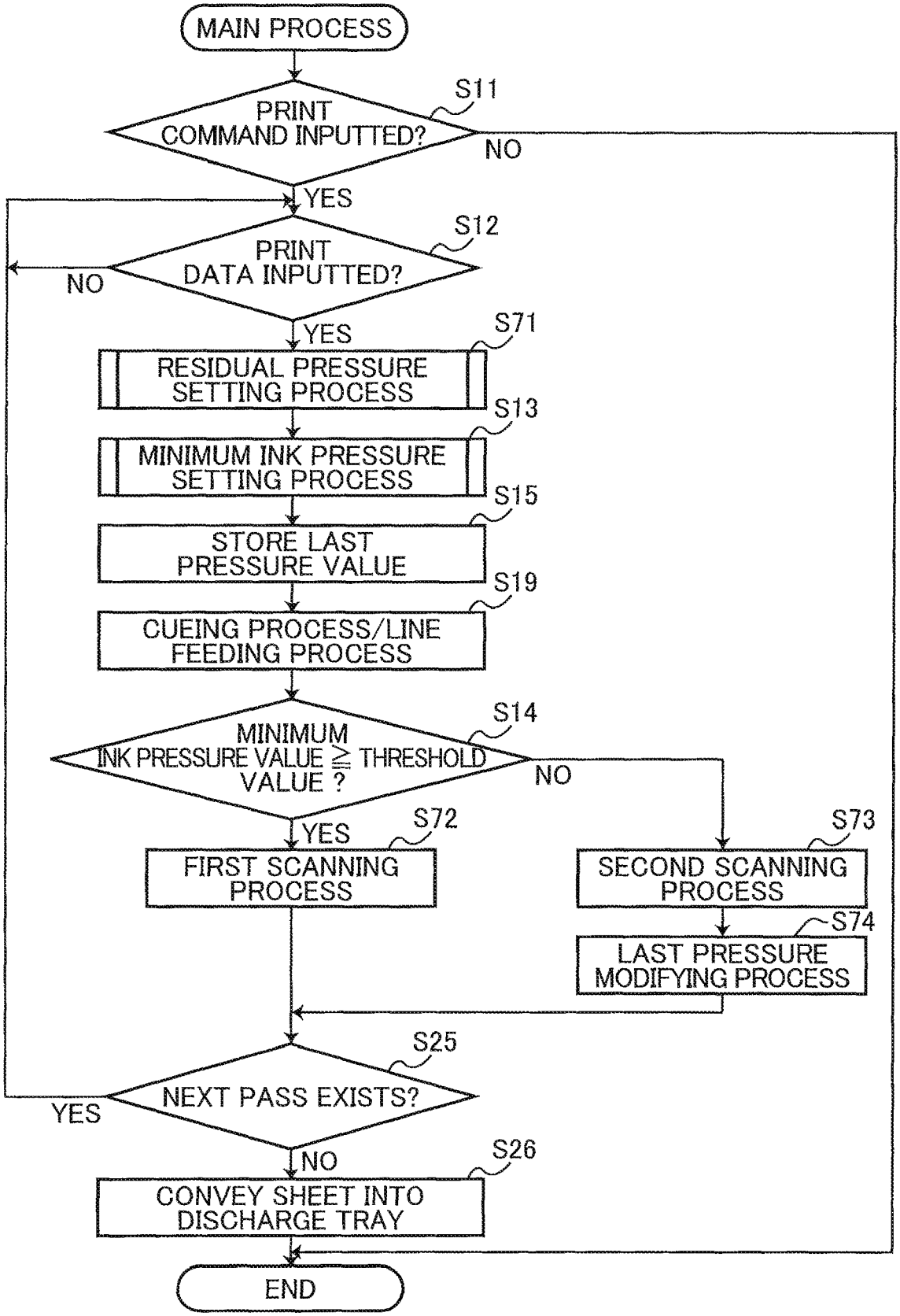
FIG. 11 is a flowchart illustrating steps in a main process executed by the CPU in the control device of the printer according to the fourth variation.

Here, the control program 82 executes the main process illustrated in FIG. 11 in place of the main process illustrated in FIG. 6. Note that steps in this variation that are equivalent to the steps in the embodiment are designated with the same step numbers to avoid duplicating description. Further, all other structures and processes not described below are identical to those described in the embodiment.

As in the embodiment, the control program 82 executes the process in steps S 11 and S12 to acquire print data. In S71 the control program 82 executes a residual pressure setting process for setting a residual pressure value.

Figure 8B:
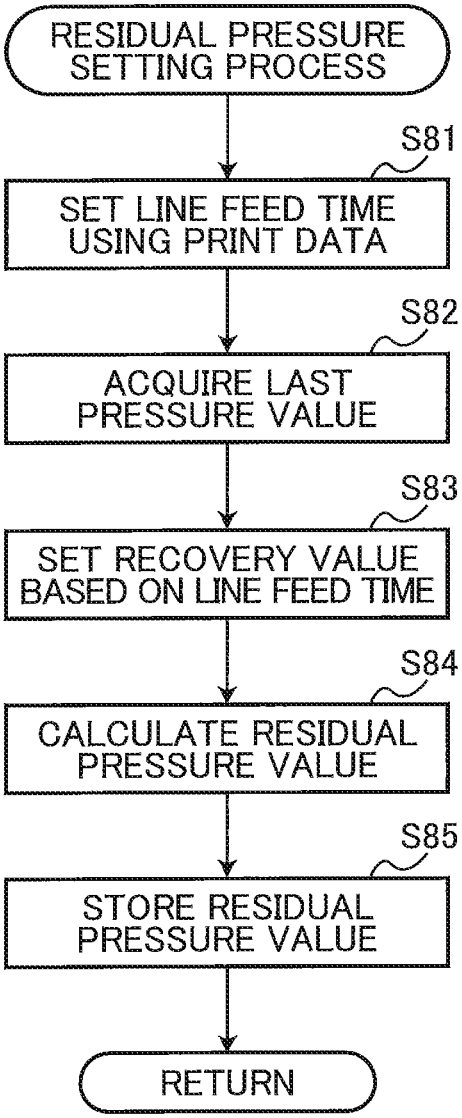
FIG. 8B is a flowchart illustrating steps in a residual pressure setting process executed by a CPU in a control device of a printer according to a fourth variation.

The residual pressure setting process according to this variation will be described with reference to FIG. 8B. In S81 at the beginning of the process in FIG. 8B, the control program 82 sets a line feed time using the print data acquired in S12. The line feed time is the time required for the line feeding process executed in S19. The method of setting the line feed time is identical to that in the embodiment.

In S82 the control program 82 reads and acquires the last pressure value stored in the storage unit 73, as in the embodiment. In S83 the control program 82 also sets a recovery value based on the line feed time acquired in S81. The ROM 76 or EEPROM 78 of the storage unit 73 stores either a table specifying correlations between line feed times and recovery values, or a formula for calculating the recovery value from a line feed time. When the storage unit 73 stores a table, the control program 82 selects the recovery value in the table that corresponds to the line feed time. When the storage unit 73 stores a formula, the control program 82 uses the formula to calculate the recovery value based on the line feed time.

In S84 the control program 82 calculates the residual pressure value by adding the recovery value set in S83 to the last pressure value acquired in S82. In S85 the control program 82 stores the residual pressure value calculated in S84 in the EEPROM 78 or RAM 77 of the storage unit 73, and subsequently ends the residual pressure setting process.

After completing the residual pressure setting process in S71 of FIG. 11, in S13 the control program 82 executes the minimum ink pressure setting process. The method of setting the minimum ink pressure value is identical to that in the embodiment. That is, the control program 82 executes the minimum ink pressure setting process illustrated in FIG. 7A. In S33 of the minimum ink pressure setting process of FIG. 7A, the control program 82 acquires the residual pressure value that was stored in the storage unit 73 in S85 of the residual pressure setting process described above (FIG. 8B) by reading the value from the storage unit 73.

In S15 the control program 82 sets the last pressure value based on the ink pressure set in the minimum ink pressure setting process of S13 and stores this last pressure value in the EEPROM 78 or RAM 77 of the storage unit 73. Next, in S19 the control program 82 executes the line feeding process. Note that, as described in the embodiment, the process executed in S19 is a cueing process when the scanning process in step S72 or S73 is the initial scanning process (initial pass) to be executed for the first time in the main process. The cueing process and line feeding process are identical to those described in the embodiment.

After completing the cueing process or line feeding process in S19, in S14 the control program 82 determines whether the minimum ink pressure value set in the minimum ink pressure setting process of S13 is greater than or equal to the threshold value stored in the storage unit 73. That is, as in the embodiment, the control program 82 determines in S14 whether the quantity of ink supplied to the head 62 will become insufficient.

If the control program 82 determines that the minimum ink pressure value is greater than or equal to the threshold value (S14: YES), in S72 the control program 82 executes a first scanning process. The first scanning process is identical to the scanning process described in the embodiment. Hence, the first scanning process prints an image in one printing area of the sheet 6 (see FIG. 9A) during one movement of the carriage 32 from one of the first position and second position to the other of the first position and second position. In other words, the first scanning process prints an image in one printing area while performing one pass. The first scanning process is an example of the first mode of print of the present disclosure.

If the control program 82 determines that the minimum ink pressure value is less than the threshold value (S14: NO), in S73 the control program 82 executes a second scanning process. The second scanning process prints an image in one printing area of the sheet 6 while reciprocating the carriage 32 between the first position and second position. In other words, the second scanning process prints an image in one printing area while performing two passes. The second scanning process is an example of the second mode of print of the present disclosure.

Here, the second scanning process will be described in greater detail. First, the control program 82 sets nozzles 67 in each nozzle row 66 to be used in a first movement of the carriage 32 (hereinafter called the "firstly-executing pass") and sets nozzles 67 in each nozzle row 66 to be used in a second movement of the carriage 32 (hereinafter called the "secondly-executing pass"). In other words, the control program 82 sets nozzles 67 that are not used in the firstly-executing pass and sets nozzles 67 that are not used in the secondly-executing pass. The number of nozzles 67 used in the firstly-executing pass is set approximately equivalent to the number of nozzles 67 used in the secondly-executing pass. In other words, both the quantity of ink ejected from nozzles 67 in the firstly-executing pass and the quantity of ink ejected from nozzles 67 in the secondly-executing pass are configured to be approximately half the total quantity of ink ejected from nozzles 67 in one pass if the first scanning process were executed.

Here, rather than setting nozzles 67 to be used in a firstly-executing pass and nozzles 67 to be used in a secondly-executing pass, the control program 82 may set an ejection number denoting the number of ink ejections by nozzles 67 in the firstly-executing pass, and an ejection number denoting the number of ink ejections by nozzles 67 in the secondly-executing pass. The ejection number denoting the number of ink ejections by nozzles 67 in the firstly-executing pass may be the same as the ejection number denoting the number of ink ejections by nozzles 67 in the secondly-executing pass, for example. Hence, the quantity of ink ejected from nozzles 67 in the firstly-executing pass (hereinafter called the "first ink quantity") and the quantity of ink ejected from nozzles 67 in the secondly-executing pass (hereinafter called the "second ink quantity") are both approximately half the total ink quantity that would be ejected from nozzles 67 in one pass if the first scanning process were executed (hereinafter called the "expected ejection quantity").

When the first ink quantity and second ink quantity are half the expected ejection quantity, the frequency of ink ejection in the firstly-executing pass and the frequency of ink ejection in the secondly-executing pass will both be half the frequency of ink ejection in one pass if the first scanning process were executed. Cutting the frequency of ink ejection in half reduces the degree of drop in ink pressure. Thus, this variation prevents the quantity of ink supplied to the head 62 from becoming insufficient. In other words, executing the second scanning process can better suppress an insufficient quantity of ink being supplied to the head 62 than when executing the first scanning process.

After executing the second scanning process in S73, in S74 the control program 82 executes a last pressure modifying process for resetting the last pressure value and storing this value in the storage unit 73 for use in calculating the residual pressure value in the next pass. For example, the control program 82 resets the ink pressure by re-executing the minimum ink pressure setting process and resets the last pressure value on the basis of the reset ink pressure. Alternatively, the control program 82 reads a fixed value prestored in the storage unit 73 and sets the last pressure value to this fixed value. The fixed value may be zero, for example. In other words, after executing the second scanning process that ejects ink at half the frequency, the control program 82 sets the last pressure value to zero, indicating that the residual pressure value has recovered to atmospheric pressure.

After completing the first scanning process of S72 or the last pressure modifying process of S74, the control program 82 executes the process in steps S25 and S26 described in the embodiment, and subsequently ends the main process.

<Effects of the Fourth Variation>

In this variation, the second scanning process is executed to avoid an insufficient quantity of ink being supplied to the head 62 when the minimum ink pressure value is less than the threshold value, indicating a chance that the ink supply to the head 62 will be insufficient. Hence, this variation suppresses a drop in printing precision, or suppresses breakage of ink menisci in the nozzles 67.

Note that while the fourth variation describes a case in which the carriage 32 is reciprocated forward and backward in the second scanning process, the carriage 32 may be moved three or more times between the first position and second position in the second scanning process to print an image in one printing area. In other words, the second scanning process is not limited to execute two passes but may execute three or more passes.

<Fifth Variation>

The fourth variation provided above describes an example of setting nozzles 67 to be used in a firstly-executing pass and nozzles 67 to be used in a secondly-executing pass when two passes are to be executed. The fifth variation describes a case in which ink ejection from the head 62 is halted in the firstly-executing pass before the minimum ink pressure value drops below the threshold value.

Figure 8C:
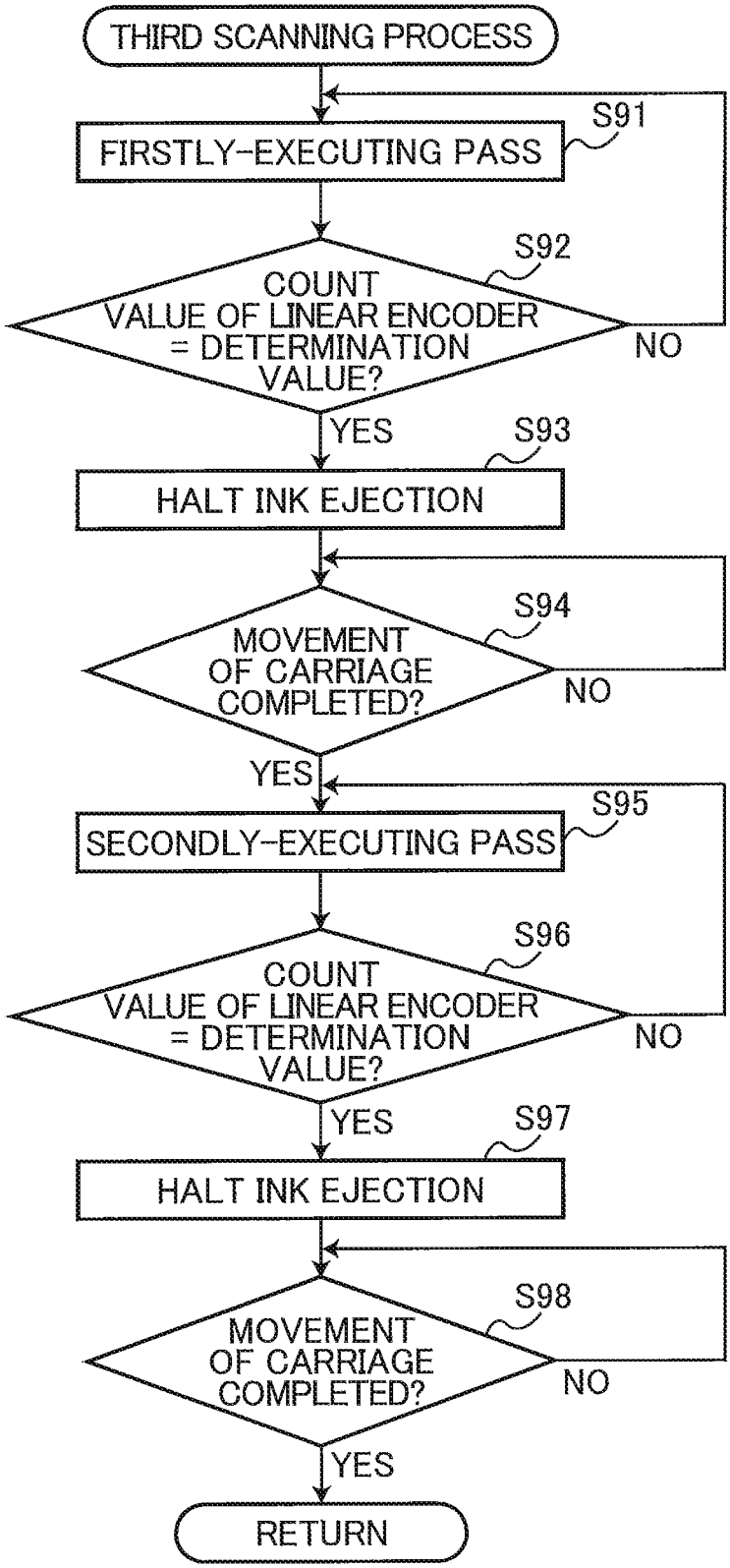
FIG. 8C is a flowchart illustrating steps in a third scanning process executed by a CPU in a control device of a printer according to a fifth variation.

Here, the control program 82 executes a third scanning process illustrated in FIG. 8C in place of the second scanning process illustrated in FIG. 11 (S73). The third scanning process is an example of the second mode of print of the present disclosure.

Prior to executing the third scanning process of FIG. 8C, the control program 82 first sets a boundary position and an ejection halting position illustrated in FIG. 9C. The boundary position indicates the position at which ink pressure set in S13 of FIG. 11 becomes less than the threshold value stored in the storage unit 73. The ejection halting position indicates a position behind the boundary position in the moving direction of the carriage 32 (to the left in the left/right directions 9 in the example of FIG. 9C) by a prescribed distance.

First, the control program 82 sets the position of the carriage 32 at which the ink pressure established in S13 coincides with the threshold value stored in the storage unit 73. Next, the control program 82 reads a prescribed distance stored in advance in the ROM 76 or EEPROM 78 of the storage unit 73. The control program 82 then sets the ejection halting position to a position separated by the prescribed distance from the boundary position in the direction opposite the moving direction of the carriage 32. Note that the ejection halting position is set as a value corresponding to a count value for the number of pulses inputted from the linear encoder 51 (hereinafter called the "determination value").

After setting the determination value, the control program 82 executes the third scanning process illustrated in FIG. 8C. In S91 at the beginning of the third scanning process, the control program 82 executes a first movement of the carriage 32 (firstly-executing pass) to move the carriage 32 from the second position to the first position while using all nozzles 67 in the head 62. In other words, in S91 the control program 82 executes the firstly-executing pass without setting nozzles 67 that are not used in the firstly-executing pass. In S92 the control program 82 counts the number of pulses inputted from the linear encoder 51 and determines whether the count value has reached the determination value described above. In other words, in S92 the control program 82 determines whether the carriage 32 has reached the ejection halting position.

If the control program 82 determines that the count value has not yet reached the determination value (S92: NO), in S91 the control program 82 continues moving the carriage 32 for the firstly-executing pass. When the control program 82 determines that the count value has reached the determination value (S92: YES), in S93 the control program 82 halts ink ejection from the head 62 without halting movement of the carriage 32. In other words, the control program 82 prints an image in the portion of the printing area rightward of the ejection halting position.

In S94 the control program 82 determines whether the carriage 32 has arrived at the first position and movement of the carriage 32 has been completed for the firstly-executing pass. While the carriage 32 has not yet reached the first position (S94: NO), the control program 82 continues moving the carriage 32 toward the first position. In other words, after halting ink ejection at the ejection halting position, the control program 82 continues moving the carriage 32 toward the first position without ejecting ink from the head 62.

When the control program 82 determines that the carriage 32 has arrived at the first position and movement of the carriage 32 has been completed for the firstly-executing pass (S94: YES), in S95 the control program 82 executes a second movement of the carriage 32 (secondly-executing pass) for moving the carriage 32 from the first position to the second position while using all nozzles 67. In other words, in S95 the control program 82 executes the secondly-executing pass without setting nozzles 67 that are not used in the secondly-executing pass, as in the firstly-executing pass of S91. In S96 the control program 82 determines whether the count value for the number of pulses inputted from the linear encoder 51 has reached the determination value. In other words, in S96 the control program 82 determines whether the carriage 32 has reached the ejection halting position. Note that while the carriage 32 is proceeding from the second position to the first position, for example, the control program 82 counts by adding up the number of pulses inputted from the linear encoder 51. When the carriage 32 is subsequently proceeding from the first position to the second position, the control program 82 counts by subtracting the number of pulses inputted from the linear encoder 51. Therefore, the control program 82 can halt ink ejection at the same ejection halting position whether the carriage 32 is proceeding from the first position to the second position or from the second position to the first position.

When the control program 82 determines that the count value has not yet reached the determination value (S96: NO), in S95 the control program 82 continues to move the carriage 32 for the secondly-executing pass. However, when the control program 82 determines that the count value has reached the determination value (S96: YES), in S97 the control program 82 halts ink ejection from the head 62 without halting movement of the carriage 32. In other words, the control program 82 prints an image during the secondly-executing pass in the portion of the printing area leftward of the ejection halting position, i.e., the portion not printed in the firstly-executing pass.

In S98 the control program 82 determines whether the carriage 32 has arrived at the second position and movement of the carriage 32 has been completed in the secondly-executing pass. While the carriage 32 has not yet reached the second position (S98: NO), the control program 82 continues moving the carriage 32 toward the second position. In other words, after halting ink ejection at the ejection halting position, the control program 82 continues moving the carriage 32 to the second position without ejecting ink from the head 62.

When the control program 82 determines that the carriage 32 has arrived at the second position and movement of the carriage 32 has been completed for the secondly-executing pass (S98: YES), the control program 82 ends the third scanning process and advances to S74 in the main process of FIG. 11.

Note that the fifth variation provided above describes an example in which the carriage 32 is moved from the second position to the first position in a firstly-executing pass and is subsequently moved from the first position to the second position in a secondly-executing pass. However, the carriage 32 may be moved from the first position to the second position in the firstly-executing pass and subsequently from the second position to the first position in the secondly-executing pass.

<Effects of the Fifth Variation>

In this variation, ink ejection is halted at an ejection halting position prior to the boundary position at which the supply of ink to the head 62 is expected to become insufficient. Therefore, this variation reliably prevents the ink supply to the head 62 from becoming insufficient. Here, the time that passes after ink ejection is halted in the firstly-executing pass and before movement of the carriage 32 begins for the secondly-executing pass allows the ink pressure that had dropped due to ink ejection in the firstly-executing pass to recover.

<Sixth Variation>

The fourth variation provided above describes a second scanning process for printing an image in one printing area by reciprocating the carriage 32 between the first position and second position (two passes). This variation describes a case in which the moving velocity of the carriage 32 is slowed to print an image in a printing area of the sheet 6. Specifically, the control program 82 executes the main process illustrated in FIG. 11. However, when the control program 82 determines that the minimum ink pressure value is less than the threshold value (S14: NO), the control program 82 executes a fourth scanning process (not illustrated) in place of the second scanning process in S73. In the fourth scanning process, the moving velocity of the carriage 32 is adjusted slower than the velocity of the carriage 32 in the first scanning process.

Here, the storage unit 73 stores the first velocity function V1(t) and second velocity function V2(t) in place of the velocity function V(t). The first velocity function V1(t) and second velocity function V2(t) are the same functions described in the third variation. The first velocity function V1(t) is used to control movement of the carriage 32 in the first scanning process. The second velocity function V2(t) is used to control movement of the carriage 32 in the fourth scanning process.

<Effects of the Sixth Variation>

In the fourth scanning process, the carriage 32 is moved at a slower velocity than the velocity of the carriage 32 in the first scanning process. When the velocity of the carriage 32 is slowed, the quantity of ink ejected from the nozzles 67 per unit time is decreased. Hence, the frequency of ink ejection (printing duty cycle) is reduced. When the frequency of ink ejection is reduced, the degree of drop in ink pressure is smaller. Hence, the fourth scanning process can prevent the ink supply to the head 62 from becoming insufficient better than the first scanning process. In this variation, the fourth scanning process is executed when there is a chance that the quantity of ink supplied to the head 62 will be insufficient, thereby avoiding this occurrence. As a result, this variation can prevent a drop in printing precision, or can prevent breakage of ink menisci in the nozzles 67.

<Seventh Variation>

In the embodiment described above, the printer 10 is provided with the carriage 32, and the head 62 for ejecting ink is mounted in the carriage 32. However, it would be apparent to those skilled in the art that various changes and modifications may be made thereto. For example, a printer in which the head 62 that ejects ink is fixed to a frame or the like may be employed in the present disclosure. In other words, so-called line printers may be employed in the present disclosure.

More specifically, a printer (hereinafter called a "line printer") has a conveying device 21 that conveys sheets, and a fixed head 62. The sheet is roll paper, for example. The roll paper is an example of the printing medium of the present disclosure.

The configuration of the conveying device 21 is generally the same as the structure of the conveying device 21 described in the embodiment, for example. The conveying motor 42 that rotates the conveying roller 24 in the conveying device 21 is an example of the drive source of the present disclosure. The direction in which the conveying roller 24 conveys the roll paper is an example of the first direction and the prescribed direction of the present disclosure.

The configuration of the head 62 is generally the same as the configuration of the head 62 described in the embodiment, for example. However, the head 62 in this variation is sufficiently wide to print an image between both widthwise ends of the roll paper.

The line printer has the control device 71 described in the embodiment. The control program 82 provided in the control device 71 acquires print data in S12 that includes image data comprising a plurality of images separated by spaces, for example. The area on a sheet in which a single image is printed is an example of the printing area of the present disclosure.

As the roll paper is conveyed, the control program 82 controls the head 62 to eject ink onto the roll paper for printing a single image. After the single image has been printed, the control program 82 halts ink ejection from the head 62 while the conveying device 21 conveys the roll paper a distance equivalent to one of the spaces described above. As in the embodiment, the control program 82 sets an ink pressure that decreases while printing a single image. The last pressure value is set to the ink pressure at the timing that printing of the single image is completed. The control program 82 also sets a conveying time required for conveying the roll paper the distance equivalent to the space using the acquired print data and the conveying speed for the roll paper. As in the embodiment described above, the control program 82 then sets a recovery value based on the established conveying time. The control program 82 calculates the residual pressure value for the timing at which printing will begin on the next single image by adding together the recovery value and the last pressure value. As in the embodiment, the control program 82 sets the ink pressure and minimum ink pressure value by adding the residual pressure value calculated above to a pressure drop that will be produced by ejecting ink from the head 62.

Next, the control program 82 determines whether the supply of ink to the head 62 will be insufficient on the basis of whether the established minimum ink pressure value is greater than or equal to the threshold value. The control program 82 changes the mode of printing to be executed between a mode for cases in which the minimum ink pressure value is determined to be greater than or equal to the threshold value, and a mode for cases in which the minimum ink pressure value is determined to be less than the threshold value. For example, when the minimum ink pressure value is less than the threshold value, the control program 82 sets the rotational speed of the conveying motor 42 slower than when the minimum ink pressure value is determined to be greater than or equal to the threshold value. The rotational speed of the conveying motor 42 may be adjusted through PWM control, as described in the embodiment.

<Effects of the Seventh Variation>

In this variation, the control device 71 sets the ink pressure indicating the pressure that ink exerts on the head 62 using the acquired print data and the established residual pressure value. Therefore, the control device 71 can set the ink pressure more accurately than when the control device 71 sets the ink pressure without being based on the residual pressure value. Thus, the control device 71 can set the ink pressure accurately without using pressure sensors. Since the control device 71 can set ink pressure accurately, the control device 71 can accurately determine whether the quantity of ink supplied to the head 62 will become insufficient.

Further, the control device 71 slows the conveying speed of the roll paper for printing when the minimum ink pressure value denoting the smallest established ink pressure is less than the threshold value. Slowing the conveying speed of the roll paper decreases the quantity of ink ejected from the head 62 per unit time. Hence, the frequency of ink ejection (the printing duty cycle) is reduced. Reducing ink ejection frequency prevents the quantity of ink supplied to the head 62 from becoming insufficient. Thus, this variation prevents a drop in printing precision, or prevents the breakage of ink menisci in the nozzles 67.

Note that rather than reducing the conveying speed of the roll paper when determining that the minimum ink pressure value is less than the threshold value, the control device 71 may temporarily halt conveyance of the roll paper and halt ink ejection from the head 62 until the ink pressure recovers.

<Other Variations>

In the embodiment described above, the control device 71 of the printer 10 is described as an example of the control device of the present disclosure. However, the "control device" of the disclosure may be the control device of a personal computer or portable terminal that is connected to the printer 10 via a communication channel In this case, the control program 82 may be a printer driver, for example. Alternatively, the control program 82 may be incorporated in the printer driver as a module.

The embodiment provided above describes a case in which the membrane sheet 50 is provided on the buffer tank 61. However, it would be apparent to those skilled in the art that various changes and modifications may be made thereto. For example, a printer not having a membrane sheet 50 provided on the buffer tank 61 may be employed in the present disclosure. When a membrane sheet 50 is not provided on the buffer tank 61, the numerical values of pressure correlated with the acceleration/deceleration of the carriage 32 in the first table and second table described above will be different values from those in the embodiment in which a membrane sheet 50 is provided on the buffer tank 61.

In the embodiment described above, the ink cartridges 18 detachably mounted in the mounting case 17 are described as examples of the receptacle of the present disclosure. However, the receptacles may be tanks fixed in the printer 10.

In the embodiment described above, the carriage motor 36 is described as an example of the drive source of the present disclosure that moves the carriage 32. However, another drive source may be employed in the present disclosure, provided that the control device 71 can control the driving.

In the embodiment described above, the minimum ink pressure value is described as an example of the second ink pressure value of the present disclosure. However, the second ink pressure value may be another value related to the pressure that ink exerts on the head 62, provided that the value can be used to determine whether the quantity of ink supplied to the head 62 will become insufficient. For example, the second ink pressure value may be the amount of negative change in ink pressure. In this case, the threshold value stored in the storage unit 73 is the absolute value of the threshold value described in the embodiment. In S14 of FIG. 6 the control program 82 determines whether the amount of negative change in ink pressure is less than or equal to the threshold value. If the amount of change is less than or equal to the threshold value (S14: YES), the control program 82 executes the scanning process in S23 without maintaining the carriage 32 in its halted state for the duration of the wait time. When the amount of change is greater than the threshold value (S14: NO), the control program 82 executes the scanning process in S23 after maintaining the carriage 32 in its halted state during the wait time. As with the minimum ink pressure value, an amount of change or other value may be used for the last pressure value described as an example of the first ink pressure of the present disclosure, provided that the value can be used to set the residual pressure value.

In the embodiment described above, a single threshold value is stored in the storage unit 73. However, a plurality of threshold values corresponding to the ambient temperature of the printer 10, the ink viscosity, the degree of ink sedimentation, and the like may be pre-stored in the storage unit 73. For example, the printer 10 may have a temperature sensor that outputs the ambient temperature. The control program 82 reads the threshold value corresponding to the temperature outputted by the temperature sensor from the storage unit 73 and executes the process in S14. Alternatively, the control program 82 may keep track of elapsed time since the ink cartridge 18 was mounted in the mounting case 17. The ink viscosity and degree of ink sedimentation increases as time elapses. The control program 82 reads a threshold value corresponding to the elapsed time from the storage unit 73 when executing the process in S14. Alternatively, the control program 82 may revise the threshold values described in the embodiment using the ambient temperature or elapsed time described above and may execute the process in S14 using the revised threshold value. A formula for revising the threshold value may be pre-stored in the storage unit 73.

In the printer 10 according to the embodiment described above, the ink cartridges 18 are not mounted on the carriage 32. However, the ink cartridges 18 may be mounted on the carriage 32. In other words, an on-carriage printer may be employed in the present disclosure.

What is claimed is:

1. A control device configured to control a printer, the printer including: a head connectable via a channel to a receptacle accommodating therein ink, the head having: a plurality of nozzles configured to eject ink; and a plurality of drive elements provided corresponding to respective ones of the plurality of nozzles; and a moving device configured to move the head relative to a printing medium, the control device comprising:

a memory configured to store a threshold value for an ink pressure that ink exerts on the head; and a controller configured to perform:

(a) acquiring print data representing an image;

(b) executing each of a plurality of prints for printing the image on the printing medium by selectively driving the plurality of drive elements, the image being made up of a plurality of partial images arranged in a first direction, the plurality of prints printing respective ones of the plurality of partial images in respective ones of a plurality of printing areas on the printing medium, the plurality of printing areas being arranged in the first direction on the printing medium, the plurality of prints including a first print and a second print subsequent to the first print, the first print printing a first partial image in a first printing area, the second print printing a second partial image in a second printing area successively positioned with respect to the first printing area in the first direction;

(c) setting a first ink pressure value using the print data, the first ink pressure value corresponding to the ink pressure for the first print;

(d) obtaining a recovery value specifying a value of the ink pressure to be recovered in a time period from completion of the first print to start of the second print;

(e) calculating a residual pressure value based on the first ink pressure value and the recovery value;

(f) setting a second ink pressure value using the print data and the residual pressure value, the second ink pressure value corresponding to the ink pressure for the second print; and (g) determining whether the second ink pressure value reaches the threshold value, wherein the (b) executing executes one of a first mode of print and a second mode of print different from the first mode of print, the first mode of print being performed in response to determining that the second ink pressure value does not reach the threshold value, the second mode of print being performed in response to determining that the second ink pressure value reaches the threshold value.

2. The control device according to claim 1, wherein the printer further includes: a conveying roller configured to convey the printing medium relative to the head in the first direction; and a conveying motor configured to rotate the conveying roller, wherein the moving device includes: a carriage configured to mount the head thereon; and a drive source configured to move the carriage in a second direction orthogonal to the first direction, the carriage being movable between a first position and a second position in the second direction, wherein in the (b) executing, each of the plurality of prints includes:

a scan ejecting ink from the head onto the printing medium while bidirectionally moving the carriage between the first position and the second position; and a line feed conveying the printing medium in the second direction by the conveying roller after the scan is performed, the plurality of prints being executed by repeatedly and alternately performing the scan and the line feed, and wherein the first print includes a first scan and a first line feed, and the second print includes a second scan and a second line feed, the first scan ejecting ink in the first printing area, the second scan ejecting ink in the second printing area.

3. The control device according to claim 2, wherein the (d) obtaining comprises:

(d1) setting a line feed time using the print data, the line feed time being a time required for the line feed; and (d2) calculating the recovery value based on the line feed time.

4. The control device according to claim 2, wherein the controller is configured to further perform:

(h) setting a wait time in response to determining that the second ink pressure value reaches the threshold value, the (h) setting being performed before the (b) executing executes the second mode of print, and wherein in a case where the (b) executing executes the second mode of print as the second print, the second scan is performed after an elapsed time reaches the wait time, the elapsed time being a time elapsed after completion of the first scan or the first line feed.

5. The control device according to claim 4, wherein the (d) obtaining calculates the recovery value based on the wait time.

6. The control device according to claim 4, wherein the (h) setting sets the wait time based on the first ink pressure value.

7. The control device according to claim 2, wherein in a case where the (b) executing executes the first mode of print as the second print, the second scan ejects ink in the second printing area while moving the carriage once from one of the first position and the second position, and wherein in a case where the (b) executing executes the second mode of print as the second print, the second scan ejects ink while moving the carriage more than once between the first position and the second position.

8. The control device according to claim 7, wherein the controller is configured to further perform:

(i) specifying a boundary position at which the second ink pressure value reaches the threshold value, wherein in the case where the (b) executing executes the second mode of print as the second print, the second scan includes a firstly-executing scan moving the carriage from one of the first position and the second position and a secondly-executing scan moving the carriage from another of the first position and the second position, wherein the firstly-executing scan ejects ink from the head while moving the carriage from the one of the first position and the second position to a third position, halts ejecting ink from the head at the third position, and continues moving the carriage from the third position to the another of the first position and the second position without ejecting ink from the head, the third position being positioned between the one of the first position and the second position and the boundary position, and wherein the secondly-executing scan ejects ink from the head while moving the carriage from the another of the first position and the second position to the third position, halts ejecting ink from the head at the third position, and continues moving the carriage from the third position to the one of the first position and the second position without ejecting ink from the head.

9. The control device according to claim 2, wherein the (b) executing moves the carriage at a first speed in the first mode of print, and moves the carriage at a second speed in the second mode of print, the second speed being slower than the first speed.

10. The control device according to claim 2, wherein the printer further includes a tube having a first end connectable to the receptacle and a second end connected to the head, the tube forming the channel, wherein in each of the plurality of prints, the scan ejects ink while moving the carriage in a movement range between the first position and the second position, the movement range including a first region, a second region, and a third region, the carriage being accelerated in the first region, the carriage being maintained at a constant velocity in the second region, the carriage being decelerated in the third region, and wherein the (c) setting sets the first ink pressure value based on movement of the carriage in the first region and the third region, and the (f) setting sets the second ink pressure value based on the movement of the carriage in the first region and the third region.

11. The control device according to claim 2, wherein the controller is configured to further perform:

(j) setting a carriage speed, the scan moving the carriage at the carriage speed in each of the plurality of prints, and wherein the (c) setting sets the first ink pressure value based on the carriage speed, and the (f) setting sets the second ink pressure value based on the carriage speed.

12. The control device according to claim 1, wherein the head is fixed in the printer, and the moving device includes: a conveying roller configured to convey the printing medium relative to the head in the first direction; and a drive source configured to move the conveying roller, wherein each of the plurality of prints ejects ink from the head onto the printing medium while conveying the printing medium, and wherein the first printing area and the second printing area are separated in the first direction by a space on which ink is not ejected.

13. The control device according to claim 1, wherein the (c) setting sets the first ink pressure value corresponding to the ink pressure after the first print, and the (e) setting sets the residual pressure value by adding the recovery value to the first ink pressure value.

14. The control device according to claim 1, wherein the threshold value is set to a value based on a diameter of each of the plurality of nozzles.

15. A non-transitory computer readable storage medium storing a set of program instructions for a control device configured to control a printer, the printer including: a head connectable via a channel to a receptacle accommodating therein ink, the head having: a plurality of nozzles configured to eject ink; and a plurality of drive elements provided corresponding to respective ones of the plurality of nozzles; and a moving device configured to move the head relative to a printing medium, the control device including: a memory configured to store a threshold value for an ink pressure that ink exerts on the head; and a controller, the set of program instructions, when installed on and executed by the controller, causing the control device to perform:

(a) acquiring print data representing an image;

(b) executing each of a plurality of prints for printing the image on the printing medium by selectively driving the plurality of drive elements, the image being made up of a plurality of partial images arranged in a prescribed direction, the plurality of prints printing respective ones of the plurality of partial images in respective ones of a plurality of printing areas on the printing medium, the plurality of printing areas being arranged in the prescribed direction on the printing medium, the plurality of prints including a first print and a second print subsequent to the first print, the first print printing a first partial image in a first printing area, the second print printing a second partial image in a second printing area successively positioned with respect to the first printing area in the prescribed direction;

(c) setting a first ink pressure value using the print data, the first ink pressure value corresponding to the ink pressure for the first print;

(d) obtaining a recovery value specifying a value of the ink pressure to be recovered in a time period from completion of the first print to start of the second print;

(e) calculating a residual pressure value based on the first ink pressure value and the recovery value;

(f) setting a second ink pressure value using the print data and the residual pressure value, the second ink pressure value corresponding to the ink pressure for the second print; and (g) determining whether the second ink pressure value reaches the threshold value, wherein the (b) executing executes one of a first mode of print and a second mode of print different from the first mode of print, the first mode of print being performed in response to determining that the second ink pressure value does not reach the threshold value, the second mode of print being performed in response to determining that the second ink pressure value reaches the threshold value.

* * * * *